US010478034B2

(12) United States Patent
Han et al.

(10) Patent No.: US 10,478,034 B2
(45) Date of Patent: Nov. 19, 2019

(54) CLEANING APPARATUS

(71) Applicant: SAMSUNG ELECTRONICS CO., LTD., Suwon-si, Gyeonggi-do (KR)

(72) Inventors: Jung Gyun Han, Suwon-si (KR); Shin Kim, Hwaseong-si (KR); Won Kyu Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 524 days.

(21) Appl. No.: 14/832,527

(22) Filed: Aug. 21, 2015

(65) Prior Publication Data

US 2016/0174789 A1 Jun. 23, 2016

(30) Foreign Application Priority Data

Dec. 18, 2014 (KR) ..... 10-2014-0183355

(51) Int. Cl.

| | |
|---|---|
| ***A47L 9/16*** | (2006.01) |
| ***A47L 5/36*** | (2006.01) |
| ***A47L 9/19*** | (2006.01) |
| ***A47L 9/24*** | (2006.01) |

(52) U.S. Cl.

CPC ..... *A47L 5/362* (2013.01); *A47L 9/165* (2013.01); *A47L 9/1608* (2013.01); *A47L 9/1683* (2013.01); *A47L 9/1691* (2013.01); *A47L 9/19* (2013.01); *A47L 9/244* (2013.01)

(58) Field of Classification Search

CPC ..... A47L 9/165; A47L 9/1683
USPC ..... 15/350
See application file for complete search history.

(56) References Cited

U.S. PATENT DOCUMENTS

| | | | | |
|---|---|---|---|---|
| 2,849,080 | A * | 8/1958 | Enright | A47L 9/104 96/416 |
| 5,350,432 | A * | 9/1994 | Lee | A47L 9/104 55/406 |
| 6,131,239 | A * | 10/2000 | White | A47L 5/24 15/352 |
| 6,195,835 | B1 * | 3/2001 | Song | A47L 9/104 15/327.1 |
| 6,332,239 | B1 * | 12/2001 | Dubos | A47L 9/104 15/327.2 |
| 6,766,558 | B1 * | 7/2004 | Matsumoto | A47L 5/36 15/327.1 |

(Continued)

FOREIGN PATENT DOCUMENTS

| | | |
|---|---|---|
| EP | 2 621 323 | 8/2013 |
| JP | 48-54260 U | 7/1973 |

(Continued)

OTHER PUBLICATIONS

Extended European Search Report from European Patent Application No. 15185923.8, dated Apr. 22, 2016 (7 pages).

(Continued)

*Primary Examiner* — Bryan R Muller
(74) *Attorney, Agent, or Firm* — Staas & Halsey LLP

(57) ABSTRACT

A cleaning apparatus includes a dust collector detachably installed at a cleaning stick. The dust collector includes a cyclone unit to generate a cyclone stream and a dust collecting unit to collect foreign matter. In this structure, a dust collecting efficiency of the dust collector may be increased, and a load of a cleaning apparatus body may be reduced.

25 Claims, 24 Drawing Sheets

(56) References Cited

U.S. PATENT DOCUMENTS

| | | | | |
|---|---|---|---|---|
| 7,288,129 | B2 * | 10/2007 | Oh | A47L 9/104 15/327.1 |
| 7,565,853 | B2 * | 7/2009 | Arnold | A47L 9/1608 81/347 |
| 8,453,295 | B2 * | 6/2013 | Studebaker | A47L 5/225 15/347 |
| 9,241,560 | B1 * | 1/2016 | Angel | A46B 11/063 |
| 9,451,860 | B2 * | 9/2016 | Liu | B01D 45/12 |
| 2004/0107530 | A1 | 6/2004 | Lee | |
| 2007/0119129 | A1 * | 5/2007 | Jeon | A47L 9/1608 55/337 |
| 2009/0265877 | A1 | 10/2009 | Dyson et al. | |

FOREIGN PATENT DOCUMENTS

| | | |
|---|---|---|
| JP | 2003-210369 | 7/2003 |
| JP | 2004-33313 | 2/2004 |
| KR | 10-2004-0104353 | 12/2004 |
| KR | 10-2006-0033147 | 4/2006 |
| KR | 10-2007-0042793 | 4/2007 |

OTHER PUBLICATIONS

European Office Action dated Mar. 6, 2017 from European Patent Application No. 15185923.8, 49 pages.

* cited by examiner

CLEANING APPARATUS

CROSS-REFERENCE TO RELATED APPLICATIONS

This application claims the priority benefit of Korean Patent Application No. 10-2014-0183355, filed on Dec. 18, 2014 in the Korean Intellectual Property Office, the disclosure of which is incorporated herein by reference.

BACKGROUND

1. Field

Embodiments of the disclosure relate to cleaning apparatuses, and more particularly, to cleaning apparatuses including a dust collector having an improved structure.

2. Description of the Related Art

In general, cleaning apparatuses have been developed for the convenience of cleaning. Vacuum cleaning apparatuses to collect foreign matter from a floor by using suction force generated by a motor and mopping cleaning apparatuses to mop the floor have been widely used.

A vacuum cleaning apparatus generally may include a head unit closely contacting a surface to be cleaned and a main body generating suction force which sucks foreign matter placed on the surface to be cleaned using suction force. That is, foreign matter drawn in through the head unit flows into the main body by suction force generated by the main body and filtered by a filter.

Particularly, foreign matter drawn in through the head unit is primarily filtered by a dust collector mounted on an extension pipe extending from the head unit and secondarily filtered by a cleaning apparatus body.

However, since foreign matter primarily filtered by the dust collector is larger than foreign matter filtered by the cleaning apparatus body, a flow path may be blocked and noise may be made thereby.

SUMMARY

Therefore, it is an aspect of the disclosure to provide a cleaning apparatus including a dust collector having an improved structure to increase a dust collecting efficiency.

It is another aspect of the disclosure to provide a cleaning apparatus efficiently removing foreign matter accumulated in a dust collector.

Additional aspects of the disclosure will be set forth in part in the description which follows and, in part, will be apparent from the description, or may be learned by practice of the disclosure.

In accordance with an aspect of the disclosure, a cleaning apparatus may include a cleaning apparatus body including a drive unit configured to generate suction force, a head unit through which outer air is introduced by suction force of the drive unit and closely contacting a surface to be cleaned, a cleaning stick having a stick flow path communicating with the head unit and having a first direction from the head unit as a lengthwise direction, and a dust collector including an inlet port, an outlet port spaced apart from the inlet port in the first direction, and a dust collecting flow path formed in the first direction from the inlet port to the outlet port and configured to separating foreign matter from air sucked through the head unit in a state of being coupled to the cleaning stick.

The dust collecting flow path may constitute at least one portion of the stick flow path.

A cyclone stream may flow in the dust collecting flow path.

The dust collector may be detachably installed at the cleaning stick.

The dust collector may include a cyclone unit having the dust collecting flow path and forming a cyclone stream in air introduced from the head unit, and a dust collecting unit communicating with the cyclone unit and collecting foreign matter separated from the cyclone unit.

The cyclone unit and the dust collecting unit may be installed to be separated from each other.

The cyclone unit may include a cyclone generator configured to generate a cyclone stream in air introduced through the inlet port, and an outlet guide unit forming the outlet port and guiding air flowing in the cyclone unit toward the outlet port.

The dust collector may include a dust collector body having an opening at one side and defining an appearance of the dust collector, and a dust collector cover disposed at one side of the dust collector body to open and close the opening, and the cyclone generator may be disposed at the dust collector body, and the outlet guide unit may be disposed at the dust collector cover.

The inlet port and the outlet port may be disposed at one side and the other side of the cyclone unit, respectively.

Centers of the inlet port, the cyclone generator, the outlet guide unit, and the outlet port may be aligned on the same line.

The cyclone generator may include at least one cyclone generating rib having a spiral shape and formed around the center of the inlet port to allow air introduced through the inlet port to form a cyclone stream.

The at least one cyclone generating rib may include a pair of cyclone generating ribs formed in a spiral shape and facing each other to split air introduced through the inlet port into two branches and form a cyclone stream.

The cyclone unit may include a cyclone case forming a cyclone space in which the cyclone stream generated by the cyclone generator flows and having an inner diameter of 80 mm or less, and the pair of cyclone generating ribs may be disposed in the cyclone case.

The dust collector may have a communication hole to allow foreign matter separated from the cyclone stream generated by the cyclone unit to move toward the dust collecting unit, and the outlet guide unit may include a grille unit disposed to be closer to the inlet port than the communication hole and guiding air from the inside of the cyclone unit toward the outlet port.

The cleaning stick may include a dust collector mounting unit on which the dust collector is mounted.

The dust collector may further include a communication hole to allow foreign matter separated from the cyclone stream generated by the cyclone unit to move toward the dust collecting unit, and a re-scattering preventing rib disposed to be spaced apart from the communication hole at a predetermined distance and blocking foreign matter reversely flowing from the dust collecting unit.

The dust collector may be formed of a transparent material through which the inside of the dust collector is visible.

The cleaning stick may include an extension pipe connected to the head unit, and a handle assembly having one end connected to the extension pipe and the other end connected to the cleaning apparatus body via a flexible hose and configured to manipulate the extension pipe.

The dust collector may further include an inlet coupling unit extending from the inlet port and coupled to the extension pipe, and an outlet coupling unit extending from the outlet port and coupled to the handle assembly.

In accordance with an aspect of the disclosure, a cleaning apparatus may include a cleaning apparatus body including a drive unit configured to generate suction force, a head unit through which outer air is introduced by suction force of the drive unit and closely contacting a surface to be cleaned, a cleaning stick having one end connected to the head unit and the other end connected to the cleaning apparatus body via a flexible hose and configured to manipulate the head unit, and a dust collector detachably installed at the cleaning stick. The dust collector may include a cyclone unit configured to form a cyclone stream in air introduced from the head unit, and a dust collecting unit communicating with the cyclone unit and collecting foreign matter separated from the cyclone unit.

The dust collector may be coupled to the cleaning stick to form a portion of a flow path from the head unit to the cleaning apparatus body.

The cyclone unit and the dust collecting unit may be installed to be separated from each other.

The cyclone unit may include a cyclone generator including an inlet port communicating with the head unit and generating a cyclone stream in air introduced through the inlet port, and an outlet guide unit including an outlet port communicating with the cleaning apparatus body and guiding air from the inside of the cyclone unit toward the outlet port.

The dust collector may include a dust collector body in which the cyclone unit is disposed at one side, and the dust collecting unit is disposed at the other side, and a dust collector cover disposed at one side of the dust collector body and configured to open and close the cyclone unit and the dust collecting unit, and the cyclone generator may be disposed at the dust collector body, and the outlet guide unit may be disposed at the dust collector cover.

The inlet port and the outlet pot may be disposed at one side and the other side of the cyclone unit.

The inlet port and the outlet port may be spaced apart from each other, and centers of the inlet port, the outlet port, the cyclone generator, and the outlet guide unit may be aligned on the same line.

The cyclone generator may include at least one cyclone generating rib having a spiral shape and formed around the center of the inlet port to allow air introduced through the inlet port to form a cyclone stream.

In accordance with an aspect of the disclosure, a cleaning apparatus may include a drive unit configured to generate suction force, a head unit through which outer air is introduced by suction force of the drive unit and closely contacting a surface to be cleaned, an extension pipe extending from the head unit, a handle pipe configured to manipulate the extension pipe on which the drive unit is disposed, and a dust collector detachably installed at the handle pipe. The dust collector may include a cyclone unit configured to form a cyclone stream in air introduced from the head unit and forming a portion of a flow path from the head unit to the cleaning apparatus body, and a dust collecting unit communicating with the cyclone unit and configured to collect foreign matter separated from the cyclone unit.

The cyclone unit may include a cyclone generator including an inlet port communicating with the head unit and configured to generate a cyclone stream in air introduced through the inlet port, and an outlet guide unit including an outlet port communicating with the drive unit and configured to guide air from the cyclone stream toward the outlet port.

The drive unit may include a driving inlet port through which air is sucked and a driving outlet port through which air is discharged, and the driving inlet port may be disposed to be space apart from the driving outlet port at a distance of about 100 mm or less.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 100 is a perspective view illustrating a dust collector and constituent elements coupled to the dust collector according to an embodiment;

DETAILED DESCRIPTION

Figure 1:
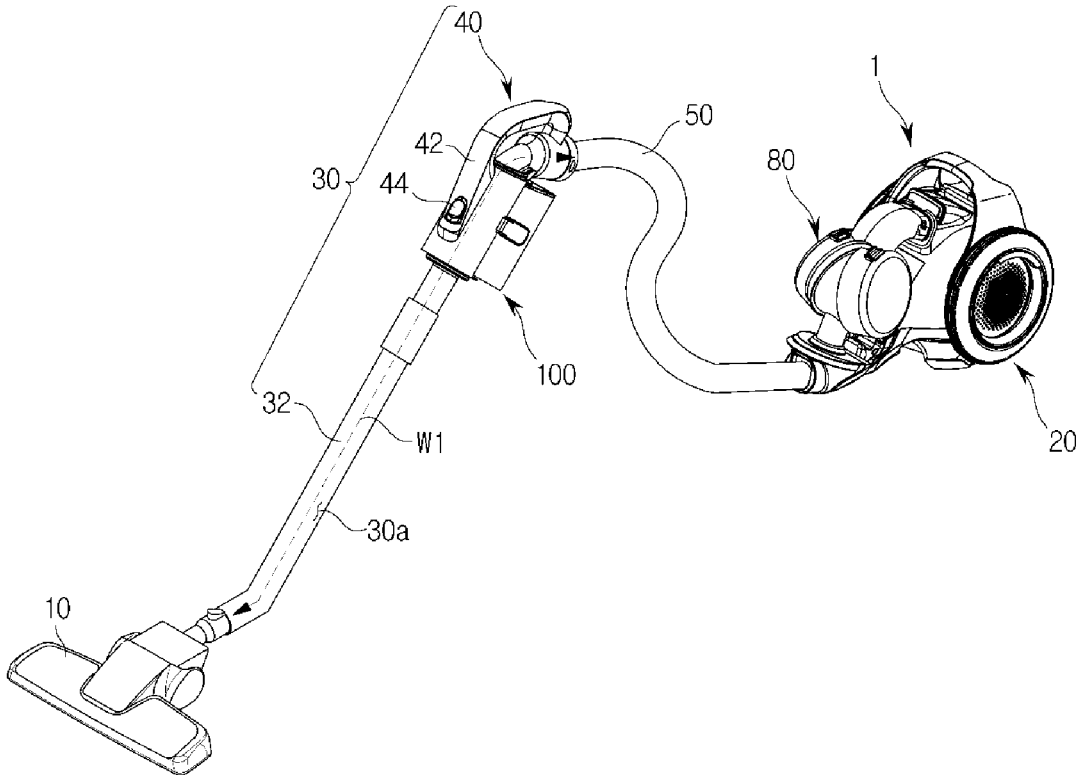
FIG. 1 is a perspective view illustrating a cleaning apparatus according to an embodiment of the disclosure.

Reference will now be made in detail to embodiments of the disclosure, examples of which are illustrated in the accompanying drawings, wherein like reference numerals refer to like elements throughout.

FIG. 1 is a perspective view illustrating a cleaning apparatus according to an embodiment of the disclosure.

A vacuum cleaning apparatus according to an exemplary embodiment may include a cleaning apparatus body 1, a body dust collector (not shown), a head unit 10, and a wheel assembly 20. The body dust collector (not shown) and the wheel assembly 20 are mounted on the cleaning apparatus body 1. A suction part provided at the head unit 10 may contact a surface to be cleaned and sucks foreign matter from the surface. The vacuum cleaning apparatus according to an embodiment may be a canister type vacuum cleaning apparatus.

The cleaning apparatus body 1 may include a drive unit (not shown) to generate suction force. The cleaning apparatus body 1 may move on a floor by the wheel assembly 20. The wheel assembly 20 may be disposed at both sides of the cleaning apparatus body 1 to allow the cleaning apparatus body 1 to easily move. The cleaning apparatus body 1 may also include a filter unit 80 to filter foreign matter.

The suction part of the head unit 10 may suck air around the surface to be cleaned and dust, debris, or particles contained in the air by using suction force generated by the cleaning apparatus body 1. The suction part may have a relatively wide shape to closely contact the surface to be cleaned.

A cleaning stick 30 and a flexible hose 50 may be disposed between the cleaning apparatus body 1 and the head unit 10. The cleaning stick 30 may be used to manipulate the head unit 10, for example, to change a cleaning direction, by a user. One end of the cleaning stick 30 may be connected to the head unit 10, and the other end of the cleaning stick 30 may be connected to the cleaning apparatus body 1 via the flexible hose 50.

The cleaning stick 30 may have a stick flow path 30*a* in which outer air introduced from the head unit 10 flows. The stick flow path 30*a* may be formed to communicate with the head unit 10. The cleaning stick 30 may extend from the head unit 10 in a first direction W1 as a lengthwise direction thereof, and thus the stick flow path 30*a* may be formed along the first direction W1 in the cleaning stick 30.

The cleaning stick 30 may include an extension pipe 32 and a handle assembly 40. The extension pipe 32 may be formed of a resin or metal and connect the head unit 10 with the handle assembly 40. The extension pipe 32 may be pivotally connected to the head unit 10 to allow a joint-like movement.

The handle assembly 40 may be formed to connect the extension pipe 32 with the flexible hose 50. The handle assembly 40 may include a handle unit 42 and a manipulation unit 44. The user may perform cleaning while gripping the handle unit 42 and control functions of the vacuum cleaning apparatus, such as on/off functions or suction force control functions by using buttons provided at the manipulation unit 44.

The flexible hose 50 connects the handle assembly 40 with the cleaning apparatus body 1. The flexible hose 50 may be formed of a flexible material to easily move the handle assembly 40.

The head unit 10, the extension pipe 32, the handle assembly 40, and the flexible hose 50 may communicate with one another. Air sucked through the suction part of the head unit 10 sequentially passes through the extension pipe 32, a dust collector 100, which will be described later, and the flexible hose 50 to be introduced into the cleaning apparatus body 1.

The dust collector 100 may be detachably installed at the cleaning stick 30. According to an embodiment, the dust collector 100 may be detachably installed at the handle assembly 40. The dust collector 100 will be described in more detail later.

Figure 2:
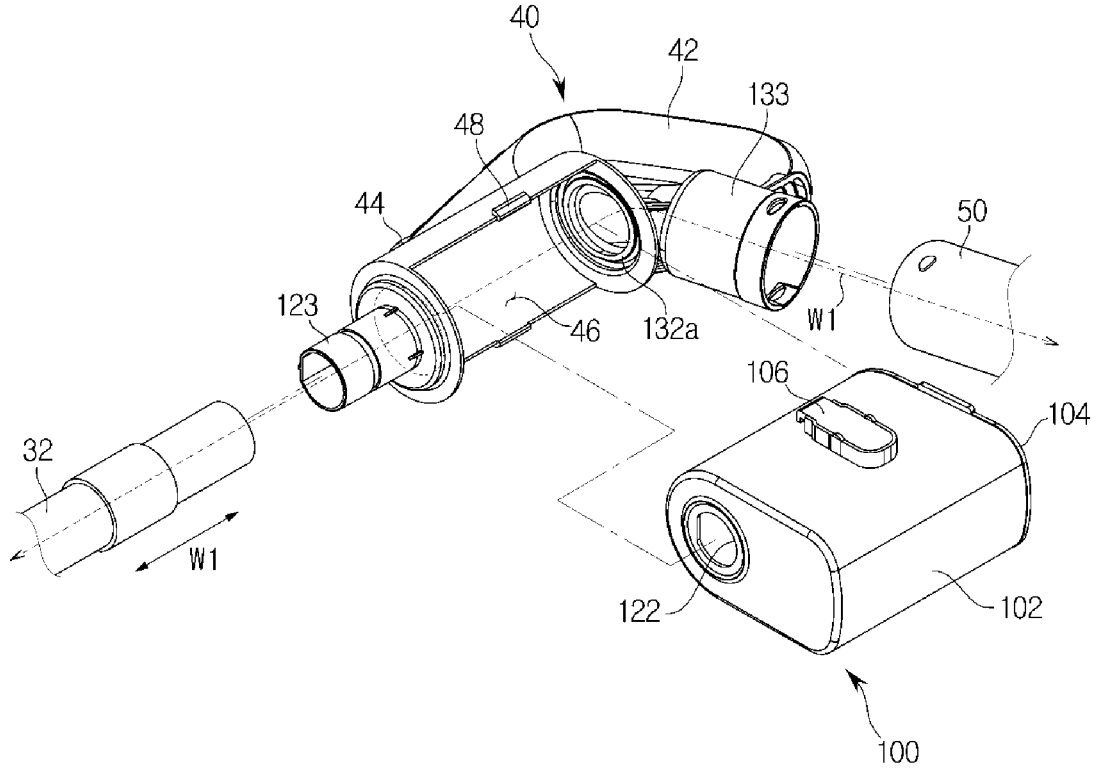
FIG. 2 is an exploded perspective view illustrating a portion of the cleaning apparatus according to an embodiment.

FIG. 2 is an exploded perspective view illustrating a portion of the cleaning apparatus according to an embodiment.

The dust collector 100 may be provided at the handle assembly 40 and separates foreign matter contained in air introduced from the head unit 10 from the air.

The dust collector 100 may be located above (at an upper position than) the cleaning apparatus body 1 to separate the foreign matter.

The dust collector 100 may be detachably installed at the handle assembly 40. By separating the dust collector 100 from the handle assembly 40, the dust collector 100 may be maintained or repaired separately from the vacuum cleaning apparatus, and foreign matter contained in the dust collector 100 may be removed.

The cleaning stick 30 may be provided with a dust collector mounting unit 46 on which the dust collector 100 is mounted. In detail, the dust collector mounting unit 46 may be provided at the handle assembly 40.

The dust collector mounting unit 46 may have a relatively recessed shape corresponding to an appearance or shape of the dust collector 100.

The handle assembly 40 may be provided with an inlet coupling unit 123 and an outlet coupling unit 133 which are adjacent to the dust collector mounting unit 46. The inlet coupling unit 123 may communicate with an inlet port 122, which will be described later, of the dust collector 100 and communicate with an outlet port 132, which will be described later, of the dust collector 100.

The inlet coupling unit 123 may protrude from the handle assembly 40 to be inserted into the extension pipe 32 and coupled thereto. The outlet coupling unit 133 may protrude from handle assembly 40 to be inserted into the flexible hose 50 and coupled thereto.

The dust collector 100 may include a catch button 106, and the dust collector mounting unit 46 may include a catch protrusion 48. The dust collector 100 and the dust collector mounting unit 46 may closely contact with each other or may be coupled with each other by mounting the dust collector 100 on the dust collector mounting unit 46 such that the catch button 106 is held by the catch protrusion 48. An example of mounting the dust collector 100 on the handle assembly 40 is described. However, the disclosure is not limited thereto, and the dust collector 100 may also be mounted on the handle assembly 40 by using other elements.

The dust collector 100 may be formed of a transparent material such that the inside of the dust collector 100 is visible. In this structure, the user may determine an amount of foreign matter accumulated in the dust collector 100 and vacate (empty) the dust collector 100. However, in one or more embodiments only a portion of the dust collector 100 may be formed of a transparent material, or the dust collector 100 may be formed of an opaque material or a semi-transparent material.

Figure 3:
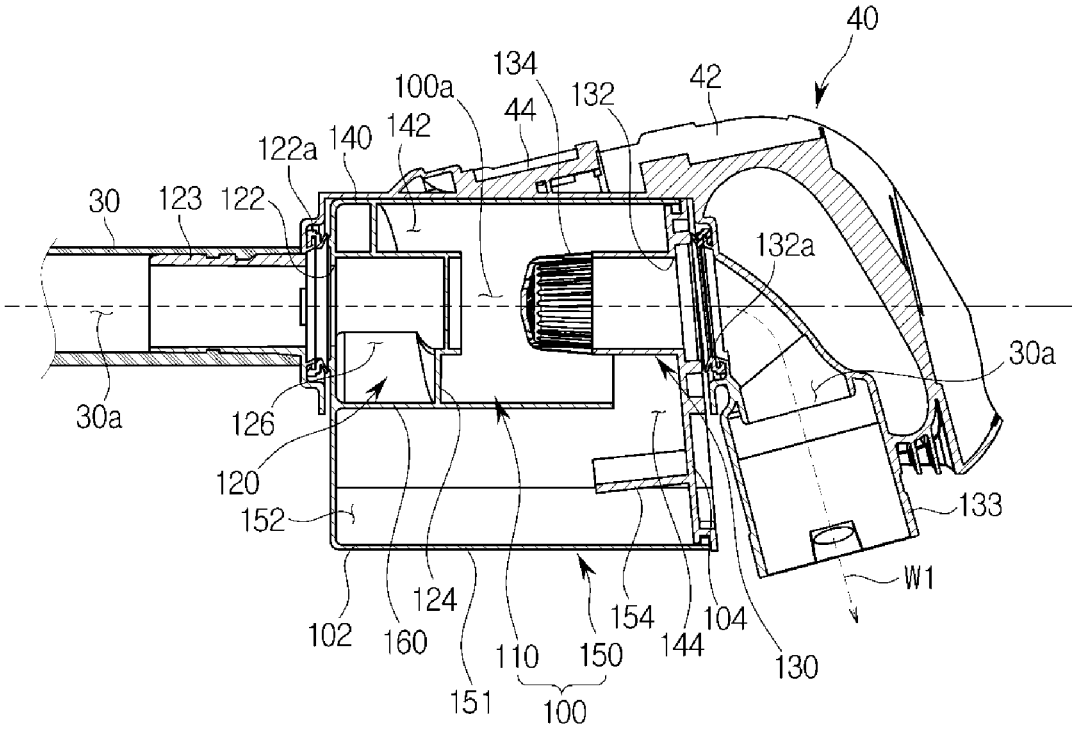
FIG. 3 is a cross-sectional view illustrating a dust collector and constituent elements coupled to the dust collector according to an embodiment.
Figure 4:
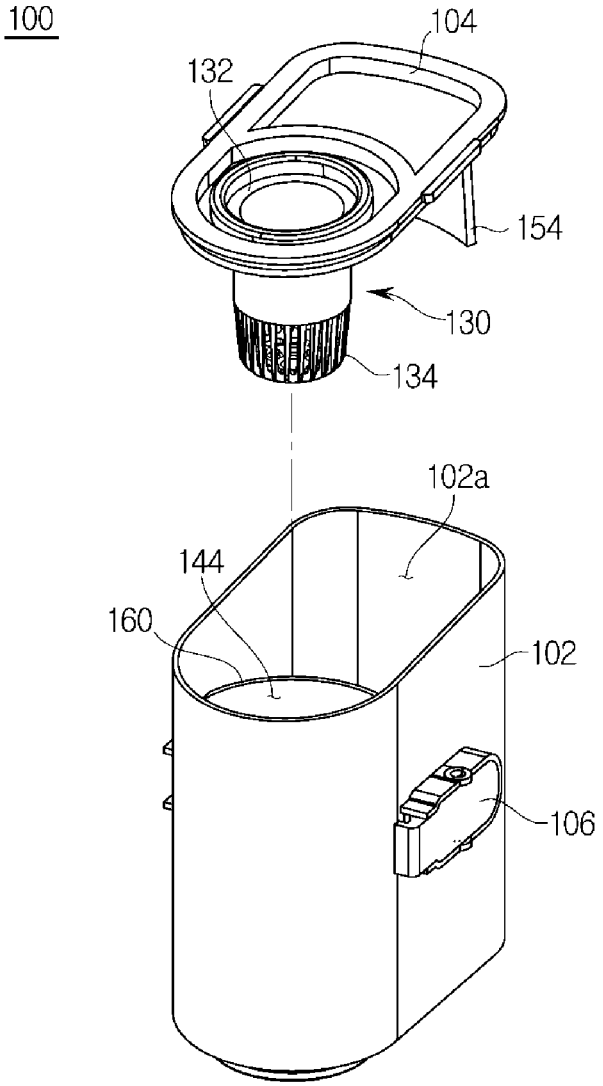
FIG. 4 is an exploded perspective view illustrating the dust collector according to an embodiment.
Figure 5A:
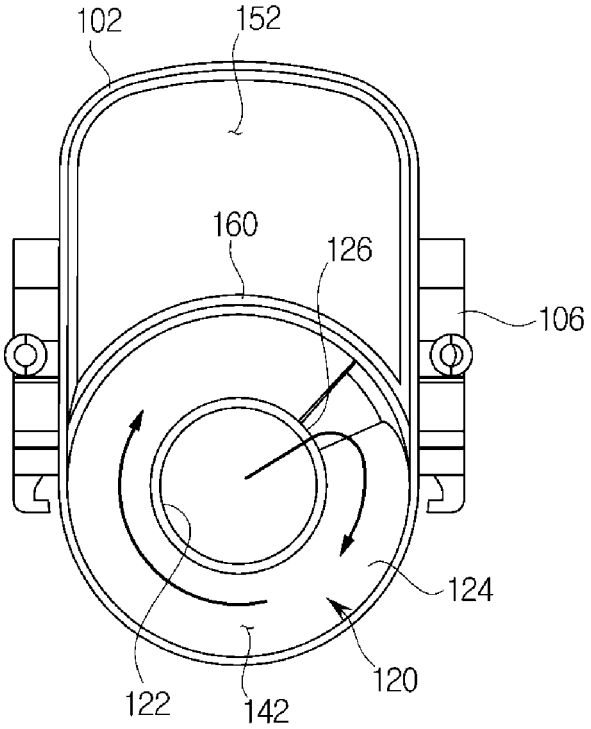
FIGS. 5A and 5B are front views illustrating the dust collector according to an embodiment.
Figure 5B:
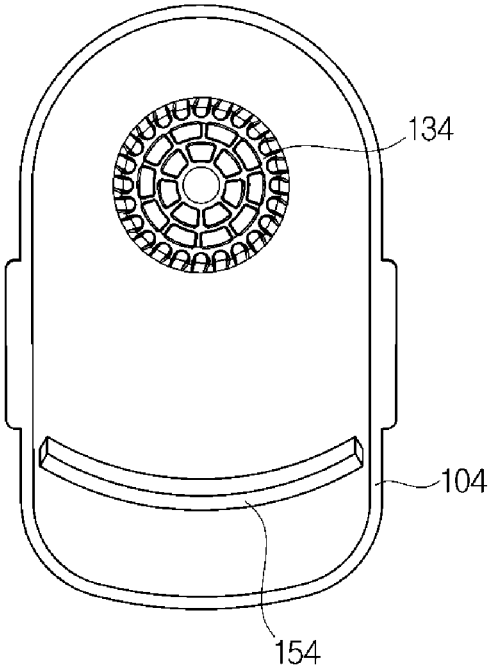
Figure 6:
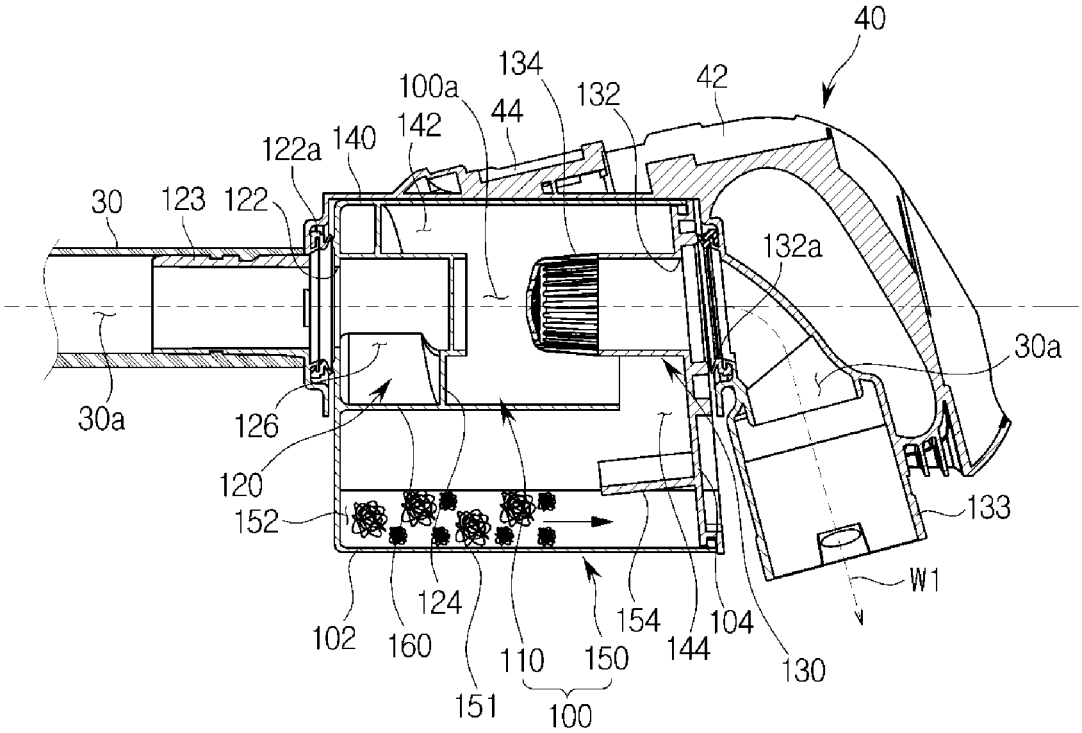
FIG. 6 is a cross-sectional view illustrating the dust collector and the constituent elements coupled to the dust collector according to an embodiment for describing movement of foreign matter.

FIG. 3 is a cross-sectional view illustrating the dust collector 100 and constituent elements coupled to the dust collector 100 according to an embodiment. FIG. 4 is an exploded perspective view illustrating the dust collector 100 according to an embodiment. FIGS. 5A and 5B are front views illustrating the dust collector 100 according to an embodiment. FIG. 6 is a cross-sectional view illustrating the dust collector 100 and constituent elements coupled to the dust collector 100 according to an embodiment for describing movement of foreign matter.

The dust collector 100 may include a cyclone unit 110 and a dust collecting unit 150.

The cyclone unit 110 forms a cyclone stream in air introduced from the head unit 10. As the cyclone unit 110 forms the cyclone stream, foreign matter is separated from the air introduced from the head unit 10.

The cyclone unit 110 may include a cyclone generator 120 and an outlet guide unit 130. The cyclone unit 110 may further include a cyclone case 140 constituting a cyclone space 142 in which the cyclone stream flows.

The cyclone generator 120 may include an inlet port 122 through which air is introduced into the dust collector 100 and generates a cyclone stream in the air introduced through the inlet port 122. The inlet port 122 may communicate with the head unit 10 and may be connected to the extension pipe 32. An inlet port packing 122*a* may be provided around the inlet port 122 such that air introduced via a flow path of the extension pipe 32 is not discharged from the inlet port 122.

The cyclone generator 120 may include at least one cyclone generating rib 124 having a spiral shape and formed around the center of the inlet port 122 such that air introduced through the inlet port 122 forms a cyclone stream. The at least one cyclone generating rib 124 may have a spiral shape such that air introduced through the inlet port 122 forms a cyclone stream while flowing into the cyclone case 140. Since the cyclone stream is generated by the cyclone generator 120, the air introduced through the inlet port 122 is separated from foreign matter by centrifugal force.

An inlet hole 126 through which air introduced through the inlet port 122 flows into the cyclone unit 110 is formed at a lower portion of the cyclone generating rib 124. According to the embodiment, air introduced into the cyclone unit 110 through one inlet hole 126 forms the cyclone stream by the cyclone generating rib 124. However, the number of the inlet hole 126 is not limited thereto as described above, and more inlet holes 126 may also be formed and a corresponding number of cyclone generating ribs 124 may be used.

Although one cyclone generating rib 124 is used as an example herein, the number of the cyclone generating rib 124 is not limited thereto.

The outlet guide unit 130 may include an outlet port 132 through which air flowing from the dust collector 100 is discharged and guides an air flow from the cyclone stream toward the outlet port 132.

The outlet port 132 may communicate with the cleaning apparatus body 1 and may be connected to the flexible hose 50. An outlet port packing 132*a* may be provided around the outlet port 132 such that air flowing from the outlet port 132 is not discharged while passing through the flexible hose 50.

The outlet guide unit 130 may include a grille unit 134 located at a position closer to the inlet port 122 than a communication hole 144, which will be described later.

The grille unit 134 may be disposed at one end of the outlet guide unit 130. Since air flowing in the cyclone unit 110 moves toward the outlet port 132 through the grille unit 134 of the outlet guide unit 130, foreign matter of the cyclone unit 110 may be filtered.

In addition, the grille unit 134 is located at a position closer to the inlet port 122 than the communication hole 144. In this structure, as the grille unit 134 is located at a position farther from the other end of the cyclone unit 110, a foreign matter collecting efficiency of the grille unit 134 is increased. Air introduced into the cyclone unit 110 reciprocates forming a cyclone stream from the cyclone generator 120 disposed at one side of the cyclone unit 110 to the other side of the cyclone unit 110 and is discharged through the outlet port 132 via the grille unit 134. Foreign matter having a greater mass than air is separated from the air flow by centrifugal force. The foreign matter separated from the air flow is not introduced into the grille unit 134 and discharged to the dust collecting unit 150 via the communication hole 144.

The grille unit 134 may have a mesh shape to allow air flowing from the cyclone space 142 to the outlet port 132 to pass therethrough and to separate foreign matter from the air.

The inlet port 122 and the outlet port 132 may be spaced apart from each other. Particularly, the inlet port 122 may be disposed at one side of the cyclone unit 110, and the outlet port 132 may be disposed at the other side. In this structure, flow resistance may be minimized by minimizing interference of the air flow while air is introduced through the inlet port 122, forms the cyclone stream, and flows to the outlet port 132. Thus, the cyclone generator 120 and the outlet guide unit 130 may be disposed at one side and the other side of the cyclone unit 110, respectively.

In addition, centers of the inlet port 122, the cyclone generator 120, the outlet guide unit 130, and the outlet port 132 may be disposed on the same line. In this structure, flow resistance may be minimized by minimizing interference of air flowing in the cyclone space 142 while the air flows therein. For example, the centers of the inlet port 122, the cyclone generator 120, the outlet guide unit 130, and the outlet port 132 may be disposed on an extended line of the lengthwise direction of the extension pipe 32.

The dust collector 100 may be coupled to the handle assembly 40 to constitute a portion of a flow path from the head unit 10 to the cleaning apparatus body 1. That is, the flow path from the head unit 10 to the cleaning apparatus body 1 may be formed by coupling the dust collector 100 with the handle assembly 40.

In detail, the dust collector 100 may have a dust collecting flow path 100*a*. The dust collecting flow path 100*a* may be formed in the first direction W1 from the inlet port 122 to the outlet port 132. The dust collecting flow path 100*a* may constitute a portion of the stick flow path 30*a* formed in the cleaning stick 30. Particularly, the dust collecting flow path 100*a* may constitute a portion of the stick flow path 30*a* by mounting the dust collector 100 on the dust collector mounting unit 46.

The dust collecting flow path 100*a* is formed in the cyclone unit 110 of the dust collector 100. The cyclone stream generated by the cyclone generator 120 may flow along the dust collecting flow path 100*a*.

Since the dust collector 100 constitutes a portion of the air flow path from the head unit 10 to the cleaning apparatus body 1, air sucked through the head unit 10 flows to the cleaning apparatus body 1 via the dust collector 100.

The dust collecting unit 150 may include a dust collecting case 151 having a dust collecting space 152 in which foreign matter is accumulated and is disposed at one side of cyclone unit 110.

The dust collecting unit 150 communicates with the cyclone unit 110 and collects foreign matter separated from the cyclone unit 110. The dust collecting unit 150 is disposed at one side of the cyclone unit 110 to collect foreign matter separated from the cyclone unit 110, and the communication hole 144 through which foreign matter flows may be disposed between the dust collecting unit 150 and the cyclone unit 110. That is, the dust collecting unit 150 may be formed to cover one side of the cyclone unit 110 provided with the communication hole 144 therebetween.

The dust collecting unit 150 may include a re-scattering preventing rib 154. The re-scattering preventing rib 154 is formed to limit flowing of foreign matter in the dust collecting unit 150 such that foreign matter introduced into the dust collecting unit 150 does not flow into the cyclone unit 110.

The re-scattering preventing rib 154 may be disposed to be adjacent to the communication hole 144. Particularly, the re-scattering preventing rib 154 may be disposed in the dust collecting unit 150 to be spaced apart from the communication hole 144 at a predetermined distance. The re-scattering preventing rib 154 is formed to block a flow of foreign matter toward the communication hole 144 even when the foreign matter contained in the dust collecting unit 150 flows toward the cyclone unit 110 in accordance with a manipulation direction of the handle assembly 40.

The dust collector 100 may include a dust collector body 102 and a dust collector cover 104 disposed at the dust collector body 102.

The dust collector body 102 may define an appearance of the dust collector 100. The dust collector body 102 may have an opening 102*a* of the cyclone space 142 of the cyclone unit 110 and the dust collecting space 152 of the dust collecting unit 150. The cyclone unit 110 may be disposed at one side of the dust collector body 102, and the dust collecting unit 150 may be disposed at the other side.

The dust collector cover 104 may be formed to open or close the opening 102*a*. Inner space 142 and 152 of the cyclone unit 110 and the dust collecting unit 150 may be cleaned and maintained and repaired by opening the opening 102*a* of the dust collector body 102.

The cyclone generator 120 of the cyclone unit 110 and one portion of the cyclone case 140 may be disposed at the dust collector body 102, and the outlet guide unit 130 of the cyclone unit 110 and the other portion of the cyclone case 140 may be disposed at the dust collector cover 104. The outlet guide unit 130 and the cyclone generator 120 may be separated from each other by separating the dust collector cover 104 and the dust collector body 102 from each other, and thus the inside of the cyclone unit 110 may be cleaned. In addition, the inside of the dust collecting unit 150 may be cleaned by separating the dust collector body 102 and the dust collector cover 104 from each other.

The cyclone unit 110 and the dust collecting unit 150 may be partitioned by a partition rib 160. When the cyclone unit 110 and the dust collecting unit 150 are formed to be separated from each other, separate cases of the cyclone unit 110 and the dust collecting unit 150 may be coupled to or separated from each other. Since both the cyclone unit 110 and the dust collecting unit 150 may be disposed in the dust collector body 102 according to an embodiment, they may be partitioned by the partition rib 160. As described above, the communication hole 144 may be disposed at one end of the partition rib 160.

Hereinafter, a cleaning apparatus according to an embodiment will be described. In this regard, certain aspects of the disclosure presented above will not be repeated herein for the sake of brevity.

Figure 7A:
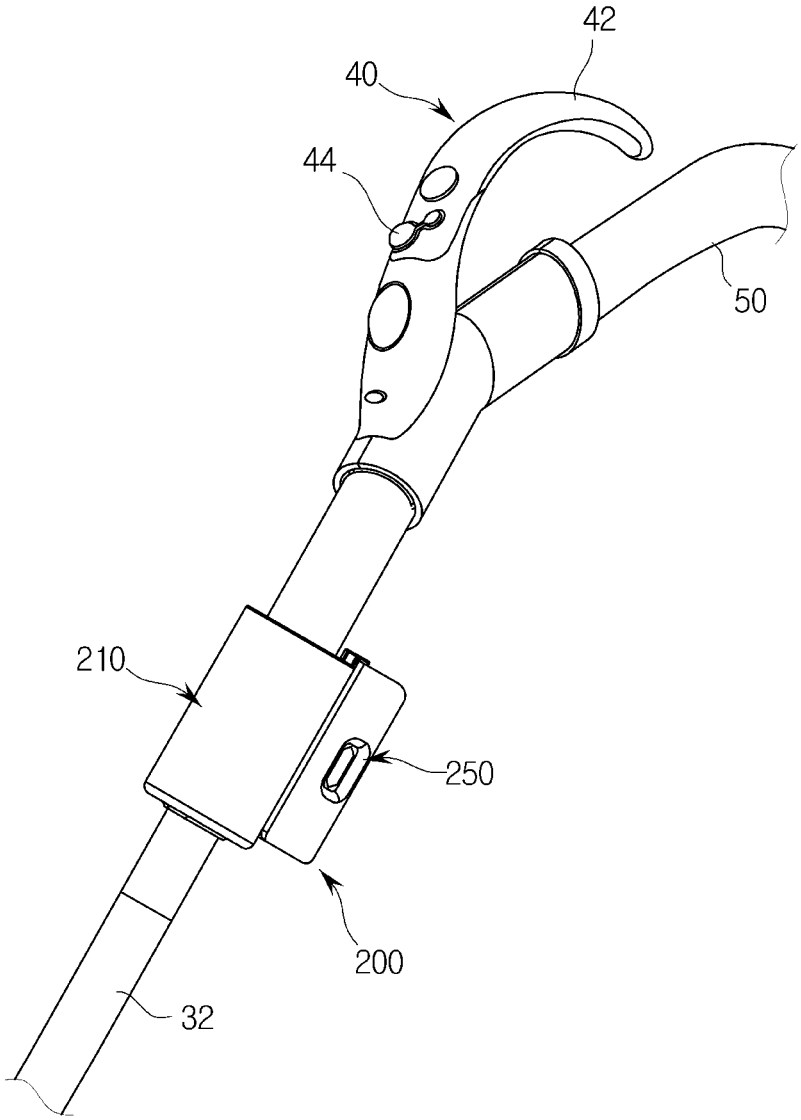
FIG. 7A is a perspective view illustrating a cleaning apparatus according to an embodiment.
Figure 7B:
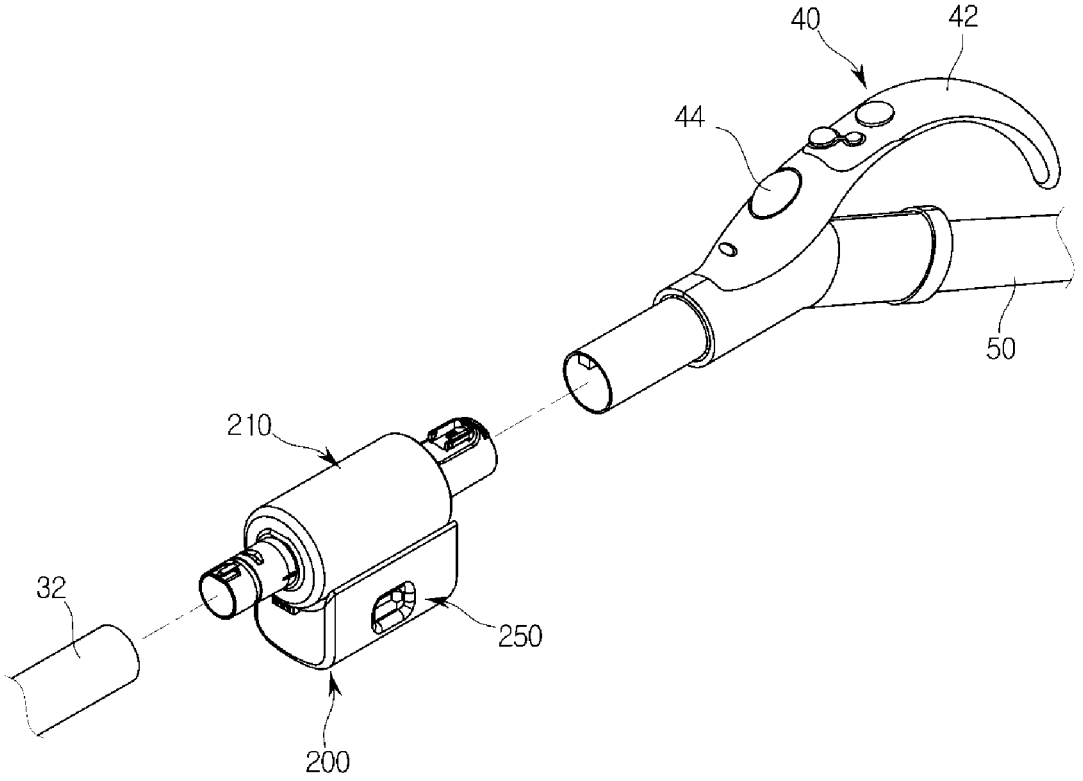
FIG. 7B is an exploded perspective view illustrating the cleaning apparatus according to an embodiment.
Figure 8A:
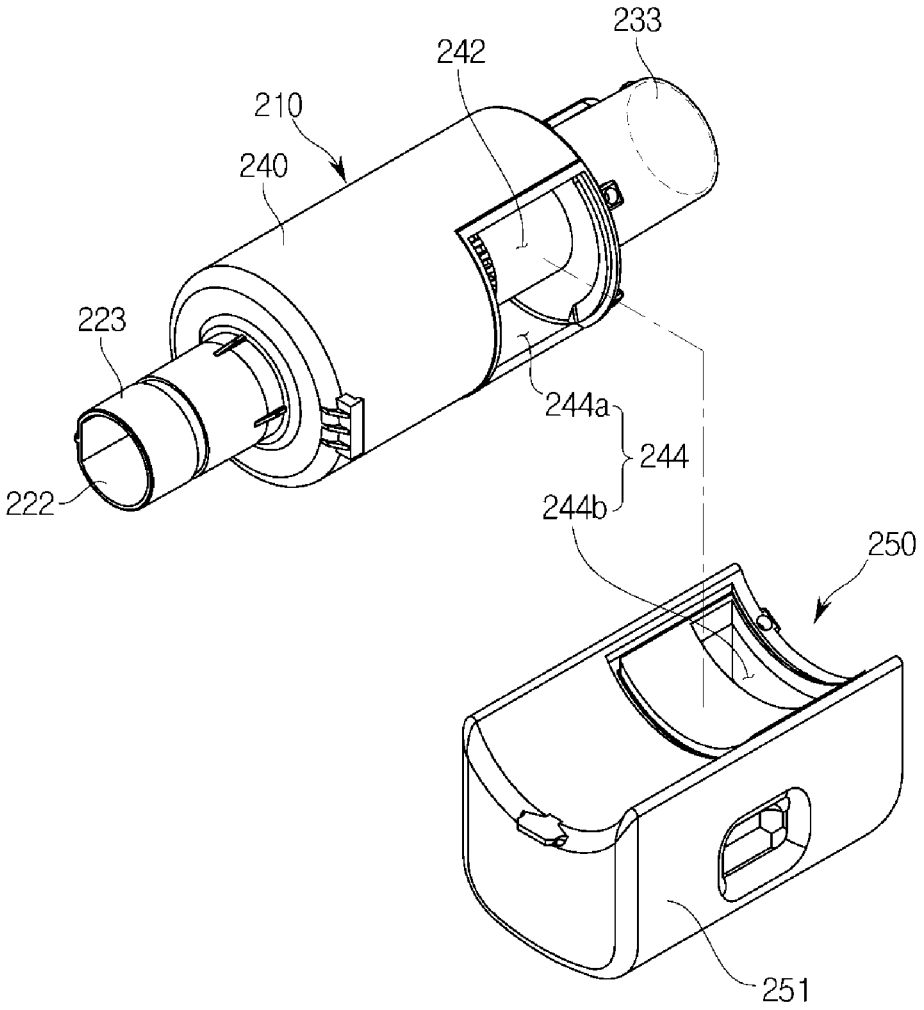
FIG. 8A is an exploded perspective view illustrating a dust collector according to an embodiment.
Figure 8B:
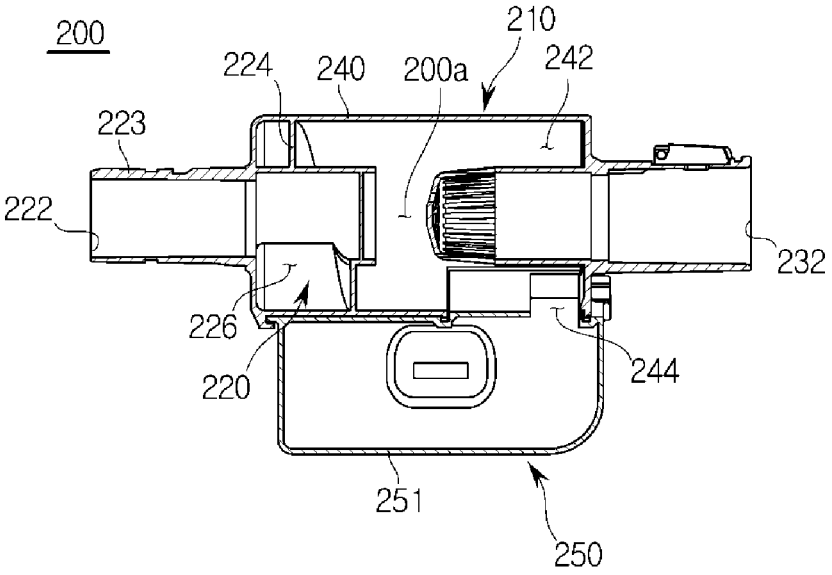
FIG. 8B is a cross-sectional view illustrating the dust collector according to an embodiment.

FIG. 7A is a perspective view illustrating a cleaning apparatus according to an embodiment. FIG. 7B is an exploded perspective view illustrating the cleaning apparatus according to an embodiment. FIG. 8A is an exploded perspective view illustrating a dust collector according to an embodiment. FIG. 8B is a cross-sectional view illustrating the dust collector according to an embodiment.

According to an embodiment, a dust collector 200 may be disposed between the handle assembly 40 and the extension pipe 32.

That is, the extension pipe 32 may be coupled to one side of the dust collector 200, and the handle assembly 40 may be coupled to the other side of the dust collector 200. However, the structure is not limited thereto. For example, one side of the dust collector 200 may be coupled to the handle assembly 40 and the other side of the dust collector 200 may be coupled to the flexible hose 50.

The dust collector 200 may include a cyclone unit 210 and a dust collecting unit 250.

The cyclone unit 210 may form a cyclone stream in air introduced from the head unit 10. As the cyclone unit 210 generates a cyclone stream, foreign matter may be separated from the air introduced from the head unit 10.

The cyclone unit 210 may include a cyclone generator 220 and an outlet guide unit 230. In addition, the cyclone unit 210 may further include a cyclone case 240 in which the cyclone stream flows.

The cyclone generator 220 may include an inlet port 222 through which air is introduced into the dust collector 200 and may generate a cyclone stream in the air introduced through the inlet port 222. The cyclone generator 220 may include at least one cyclone generating rib 224 having a spiral shape and formed around the center of the inlet port 222 such that air introduced through the inlet port 222 forms a cyclone stream.

The outlet guide unit 230 may include an outlet port 232 through which air flowing from the dust collector 200 is discharged and guides air flowing from the cyclone stream toward the outlet port 232.

The cyclone unit 210 may include an inlet coupling unit 223 extending outward from the inlet port 222 and an outlet coupling unit 233 extending outward from the outlet port 232. The inlet coupling unit 223 and the outlet coupling unit 233 may be coupled to the extension pipe 32 and the handle assembly 40, respectively. The inlet coupling unit 223 and the outlet coupling unit 233 may protrude from the cyclone unit 210 a predetermined length such that the inlet coupling unit 223 and the outlet coupling unit 233 are coupled to the extension pipe 32 and the handle assembly 40, respectively. In this structure, the dust collector 200 may constitute a portion of a flow path formed from the head unit 10 to the cleaning apparatus body 1. That is, the flow path from the head unit 10 and the cleaning apparatus body 1 may be formed by coupling the dust collector 200 between the extension pipe 32 and the handle assembly 40.

Since the dust collector 200 constitutes a portion of the flow path of air flowing from the head unit 10 to the cleaning apparatus body 1, air sucked from the head unit 10 flows to the cleaning apparatus body 1 through the dust collector 200.

The cyclone unit 210 and the dust collecting unit 250 of the dust collector 200 may be separated from each other. Since the inlet coupling unit 223 and the outlet coupling unit 233 of the cyclone unit 210 are respectively coupled to the extension pipe 32 and the handle assembly 40, foreign matter accumulated in the dust collecting unit 250 may be removed or the inside of the dust collecting unit 250 may be cleaned by separating the dust collecting unit 250 from the cyclone unit 210.

The cyclone unit 210 may have a cylindrical shape for forming a cyclone stream, and the dust collecting unit 250 may have a recessed portion with an arc-shape such that the dust collecting unit 250 may be coupled to one side of the cyclone unit 210.

The cyclone unit 210 may have a first communication hole 244*a*, and the dust collecting unit 250 may have a second communication hole 244*b* corresponding to the first communication hole 244*a*. By coupling the cyclone unit 210 with the dust collecting unit 250, the first communication hole 244*a* and the second communication hole 244*b* may correspond to each other, and foreign matter may be moved from the cyclone unit 210 to the dust collecting unit 250. The first communication hole 244*a* and the second communication hole 244*b* may form a communication hole 244.

Descriptions of the dust collecting flow path 200*a*, the cyclone generator 220, the inlet hole 226, cyclone space 242, and dust collecting case 251, will not be given herein as descriptions thereof have previously been provided.

Hereinafter, a cleaning apparatus according to an embodiment will be described. In this regard, certain aspects of the disclosure presented above will not be repeated herein for the sake of brevity.

Figure 9A:
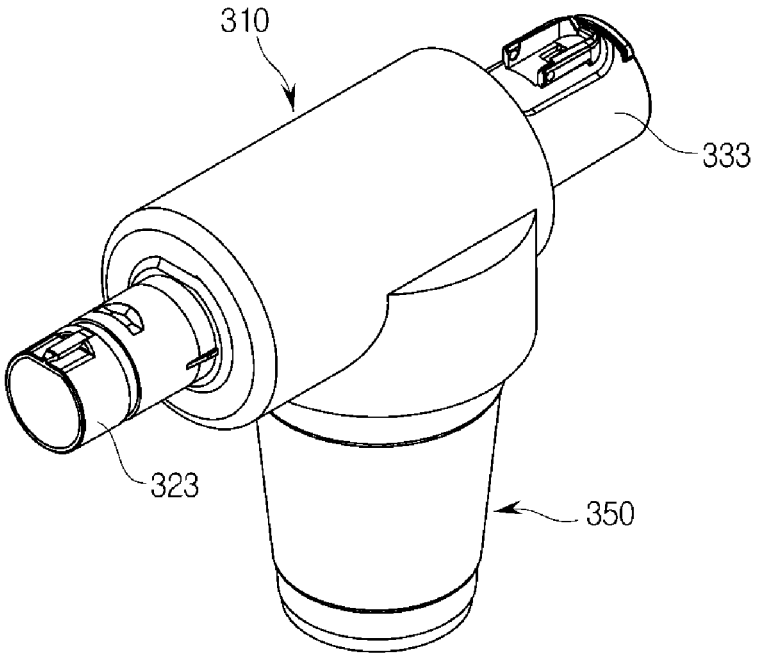
FIG. 9A is a perspective view illustrating a dust collector according to an embodiment.
Figure 9B:
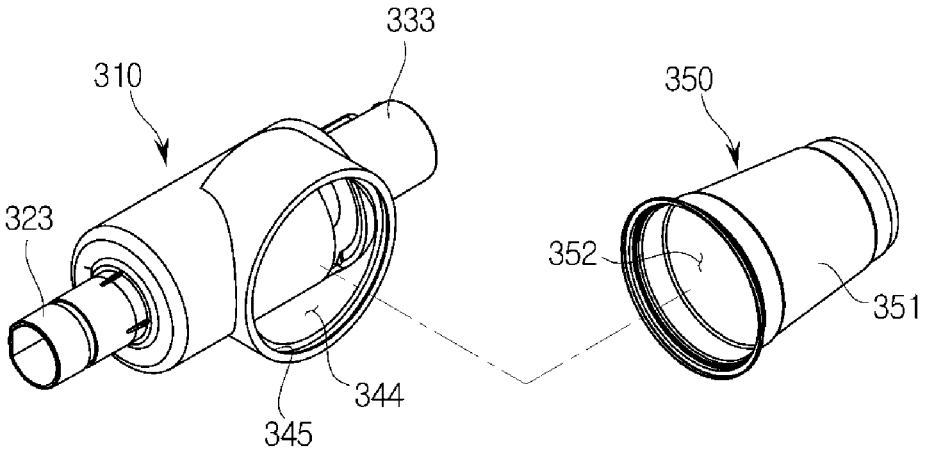
FIG. 9B is an exploded perspective view illustrating the dust collector according to an embodiment.

FIG. 9A is a perspective view illustrating a cleaning apparatus according to an embodiment. FIG. 9B is an exploded perspective view illustrating a dust collector according to an embodiment.

According to an embodiment, a dust collecting unit may be installed at a communication hole differently from the dust collecting unit according to an embodiment which covers one side of the cyclone unit as described above.

The dust collecting unit 350 may have a case shape having one open side. Particularly, the dust collecting unit 350 may have an opening 352 corresponding to the communication hole 344. By installing the dust collecting unit 350 at the cyclone unit 310, foreign matter discharged through the communication hole 344 is accumulated therein. That is, dust collecting unit 350 may include a dust collecting case 351 having a dust collecting space 352 in which foreign matter is accumulated and is disposed at one side of cyclone unit 310.

The cyclone unit 310 may include a communication hole mounting unit 345 extending from the communication hole 344, and the dust collecting unit 350 may be installed at the communication hole mounting unit 345. As the dust collecting unit 350 is installed at the communication hole mounting unit 345, the communication hole 344 may be disposed to correspond to the opening of the dust collecting unit 350.

According to an embodiment, the dust collecting unit 350 may be formed of the same material or may have the same shape as a disposable or plastic cup. Accordingly, when foreign matter is accumulated in the dust collecting unit 350, the dust collecting unit 350 may be replaced to ensure excellent hygiene, and scattering of foreign matter may be prevented while separating the dust collecting unit 350.

Descriptions of an inlet coupling unit 323 and an outlet coupling unit 333 will not be given herein as descriptions thereof have previously been provided.

Hereinafter, a cleaning apparatus according to an embodiment will be described. In this regard, as descriptions thereof have previously been provided presented above will not be repeated herein for the sake of brevity.

Figure 10A:
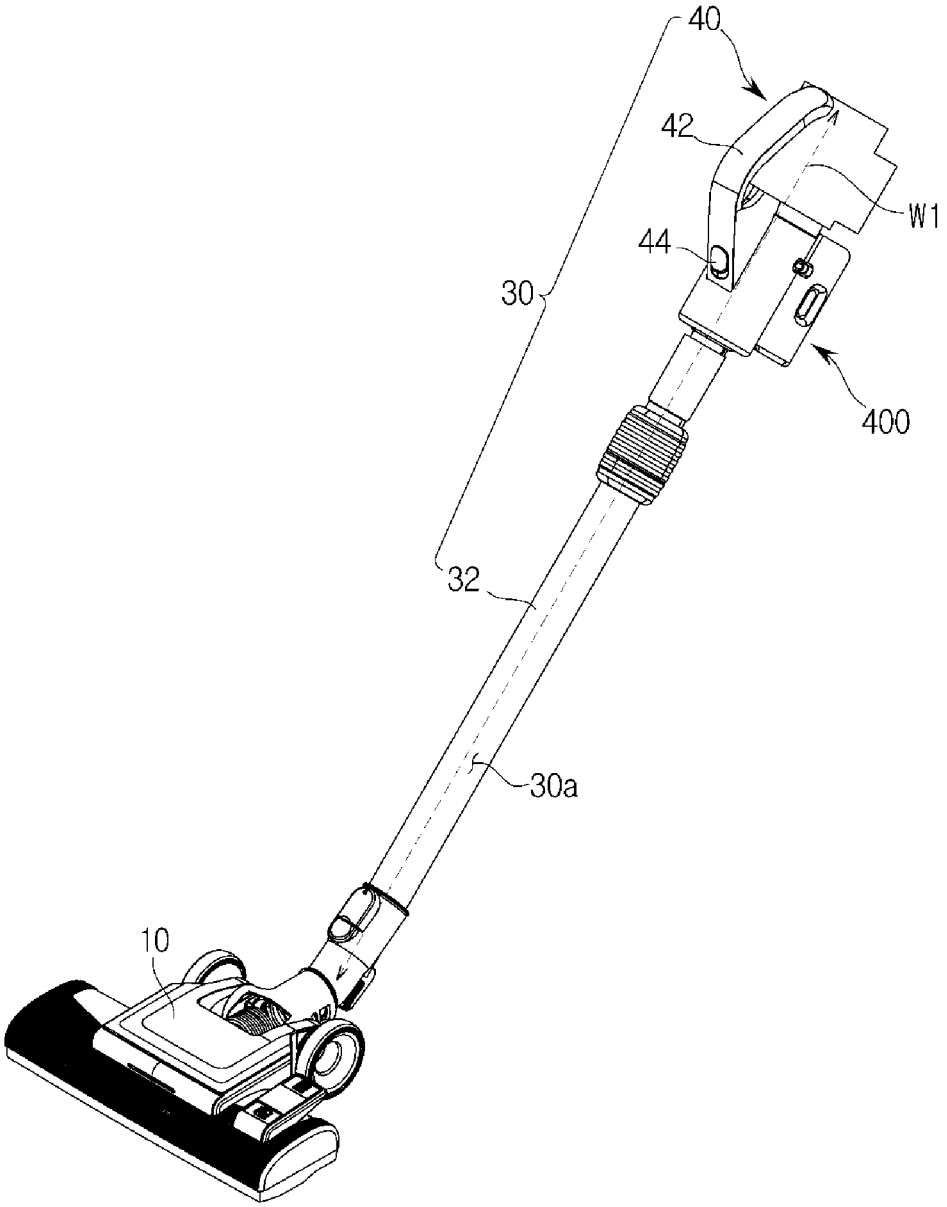
FIG. 10A is a perspective view illustrating a cleaning apparatus according to an embodiment.
Figure 10B:
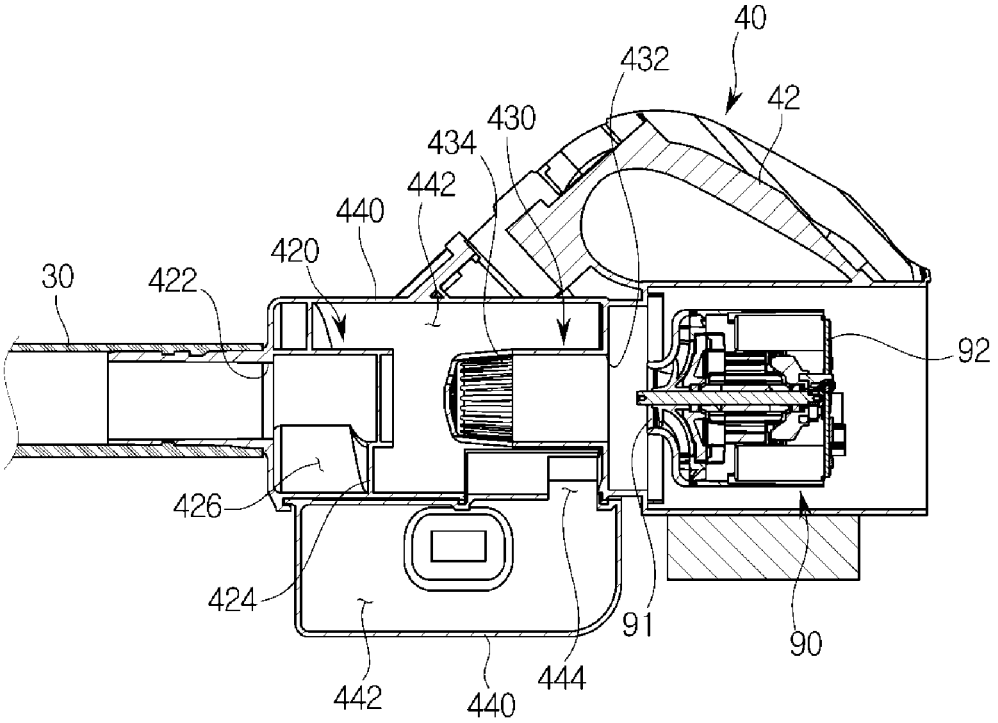
FIG. 10B is a cross-sectional view illustrating a handle assembly of the cleaning apparatus according to an embodiment.
Figure 10C:
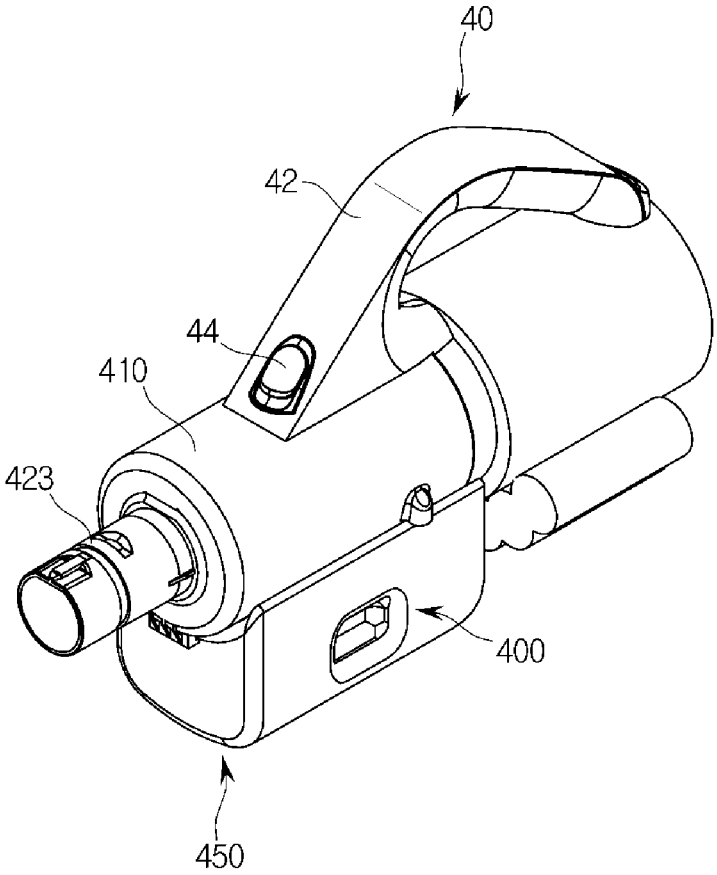

FIG. 10A is a perspective view illustrating a cleaning apparatus according to an embodiment. FIG. 10B is a cross-sectional view illustrating a handle assembly of the cleaning apparatus according to an embodiment. FIG. 100 is a perspective view illustrating a dust collector and constituent elements coupled to the dust collector according to an embodiment.

According to an embodiment, a dust collector 400 may be provided at a hand-stick type vacuum cleaning apparatus. According to an embodiment, a drive unit 90 is not provided at the cleaning apparatus body 1 but instead is disposed at the handle assembly 40 to generate suction force.

The dust collector 400 may include a cyclone unit 410 and a dust collecting unit 450.

The cyclone unit 410 may form a cyclone stream in air introduced from the head unit 10. As the cyclone unit 410 generates a cyclone stream, foreign matter may be separated from the air introduced from the head unit 10.

The cyclone unit 410 may include a cyclone generator 420 and an outlet guide unit 430. In addition, the cyclone unit 410 may further include a cyclone case 440 in which the cyclone stream flows.

The cyclone generator 420 may include an inlet port 422 through which air is introduced into the dust collector 400 and may generate a cyclone stream in the air introduced through the inlet port 422. The cyclone generator 420 may include at least one cyclone generating rib 424 having a spiral shape and formed around the center of the inlet port 422 such that air introduced through the inlet port 422 forms the cyclone stream.

The outlet guide unit 430 may include an outlet port 432 through which air flowing from the dust collector 400 is discharged and guides air flowing from the cyclone stream toward the outlet port 432.

The vacuum cleaning apparatus may include the drive unit 90 to generate suction force at a downstream of the dust collector 400. The drive unit 90 may generate suction force to suck outer air through the head unit 10.

The drive unit 90 may include a driving inlet port 91 through which air is sucked and a driving outlet port 92 through which the air is discharged. The driving inlet port 91 may be disposed to be spaced apart from the outlet port 432 of the dust collector 400. Particularly, the driving inlet port 91 and the outlet port 432 of the dust collector 400 may be spaced apart from each other at a distance of about 100 mm or less to improve suction efficiency of the drive unit 90.

Descriptions of an inlet coupling unit 423, inlet hole 426, grille unit 434, cyclone space 442, and communication hole 444, will not be given herein as descriptions thereof have previously been provided.

Hereinafter, a cleaning apparatus according to an embodiment will be described. In this regard, certain aspects of the disclosure presented above will not be repeated herein for the sake of brevity.

Figure 11A:
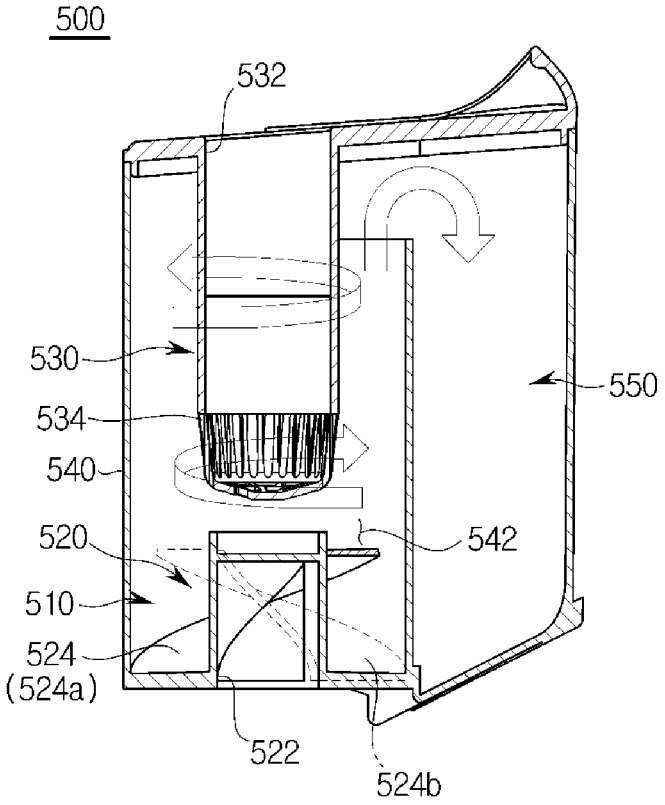
FIG. 11A is a cross-sectional view illustrating a dust collector according to an embodiment.
Figure 11B:
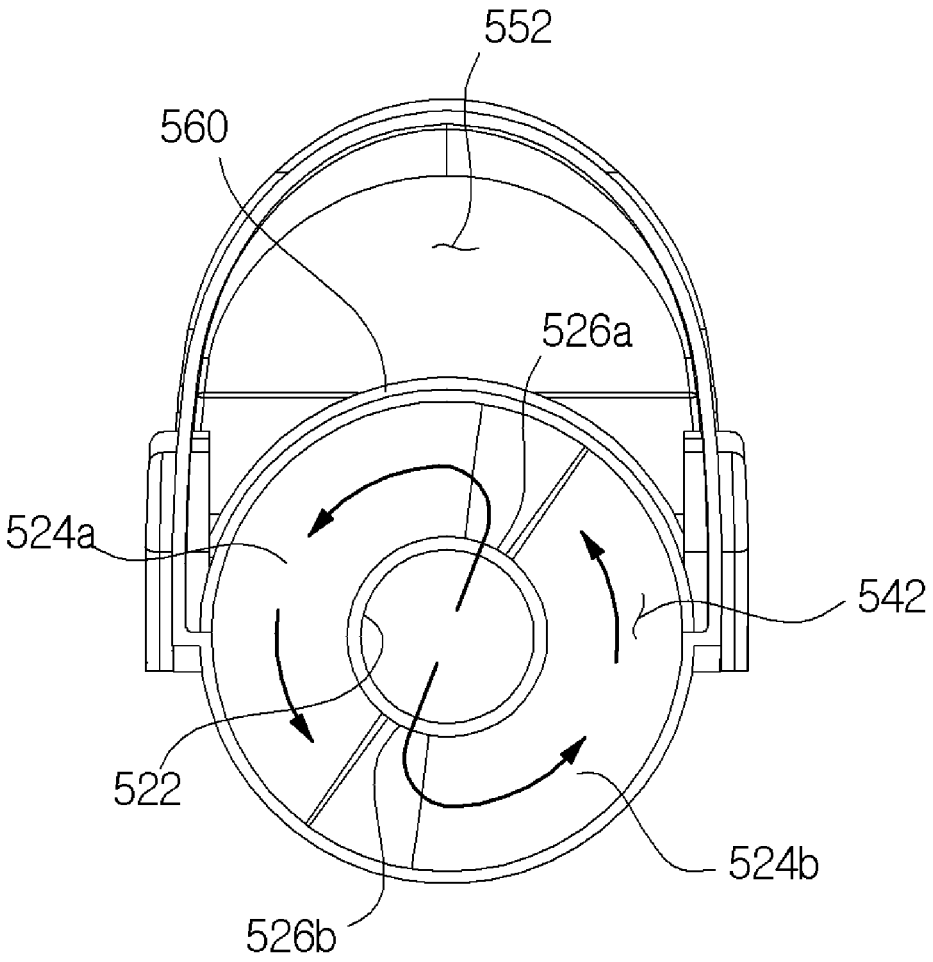
FIG. 11B is an internal front view of the dust collector according to an embodiment.
Figure 11C:
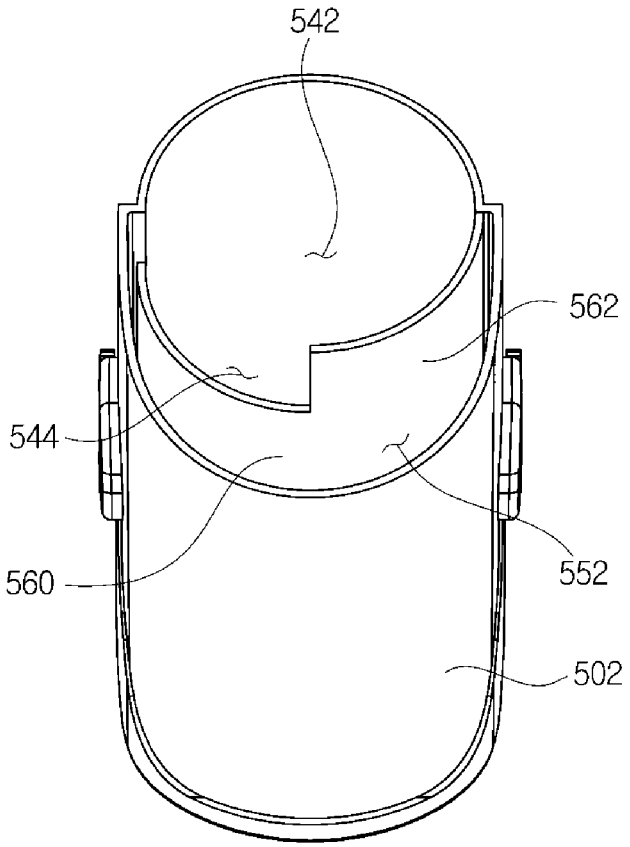
FIG. 11C is a perspective view of a dust collector body of the dust collector according to an embodiment.

FIG. 11A is a cross-sectional view illustrating a dust collector according to an embodiment. FIG. 11B is an internal front view of the dust collector according to an embodiment. FIG. 11C is a perspective view of a dust collector body of the dust collector according to an embodiment.

A dust collector 500 may include a cyclone unit 510 and a dust collecting unit 550.

The cyclone unit 510 may form a cyclone stream in air introduced from the head unit 10. As the cyclone unit 510 generates a cyclone stream, foreign matter may be separated from the air introduced from the head unit 10.

The cyclone unit 510 may include a cyclone generator 520 and an outlet guide unit 530. In addition, the cyclone unit 510 may further include a cyclone case 540 to form a cyclone space 542 in which the cyclone stream flows.

The cyclone generator 520 may include an inlet port 522 through which air is introduced into the dust collector 500 and generates a cyclone stream in the air introduced through the inlet port 522. The cyclone generator 520 may include at least one cyclone generating rib 524 having a spiral shape and formed around the center of the inlet port 522 such that air introduced through the inlet port 522 forms a cyclone stream.

The outlet guide unit 530 may include an outlet port 532 through which air flowing from the dust collector 500 is discharged and a grille unit 534, and guides air flowing from the cyclone stream toward the outlet port 532.

According to an embodiment, the cyclone generator 520 may include a pair of cyclone generating ribs 524*a* and 524*b*.

The cyclone generating ribs 524*a* and 524*b* may be disposed at both sides of the cyclone unit 510 to face each other and generate a cyclone stream in the same direction. In addition, a pair of inlet holes 526*a* and 526*b* corresponding to the cyclone generating ribs 524*a* and 524*b* are provided. By using the pair of inlet holes 526*a* and 526*b*, pressure loss of an air flow may be reduced in comparison with when one inlet hole is used.

In other words, since the pair of cyclone generating ribs 524*a* and 524*b* are provided, air introduced from the inlet port 522 is introduced into the cyclone unit 510 via the pair of inlet holes 526*a* and 526*b*. Thus, flow path resistance of the air flow is reduced using the inlet holes 526*a* and 526*b* as compared with using one inlet hole, and thus suction efficiency of the vacuum cleaning apparatus increases, and a cyclone stream is efficiently formed.

The pair of inlet holes 526*a* and 526*b* may be formed at opposite sides of the cyclone unit 510. Accordingly, air introduced through the inlet port 522 divides into two branches and is introduced into the cyclone unit 510 through each of the inlet holes 526*a* and 526*b*.

Although a pair of cyclone generating ribs 524*a* and 524*b* are used according to an embodiment, the number of cyclone generating ribs is not limited thereto.

The relationship between the number of inlet holes 526*a* and 526*b* and an inner diameter of the cyclone case 540 is not limited. However, when a pair of inlet holes 526*a* and 526*b* are provided, the inner diameter of the cyclone case 540 may be equal to or less than about 80 mm. That is, when the inner diameter of the cyclone case 540 is equal to or less than about 80 mm, flow path resistance of air introduced into the cyclone space 542 of the cyclone case 540 may be reduced and pressure loss may be reduced by using a pair of inlet holes 526*a* and 526*b*.

The cyclone unit 510 and the dust collecting unit 550 may be partitioned in a dust collector body 502 by a partition rib 560. Particularly, the cyclone space 542 of the cyclone unit 510 and a dust collecting space 552 of the dust collecting unit 550 may be partitioned by the partition rib 560. Since both the cyclone unit 510 and the dust collecting unit 550 are disposed in the dust collector body 502 according to an embodiment, they may be partitioned by the partition rib 560.

The partition rib 560 may include a reverse-flow blocking unit 562 having a step-like shape to block a reverse-flow from the dust collecting unit 550. The reverse-flow blocking unit 562 may further extend from one end of the adjacent partition rib 560 to be stepped.

By using the reverse-flow blocking unit 562, a communication hole 544 is formed at only one end of the partition rib 560 where the reverse-flow blocking unit 562 is not formed. Thus, inflow of air from the cyclone unit 510 into the dust collecting unit 550 is more difficult than inflow of air from the dust collecting unit 550 into the cyclone unit 510.

The alignment of the reverse-flow blocking unit 562 may vary according to a direction of the cyclone stream in the cyclone unit 510. Since the cyclone stream is formed counter-clockwise in a top view of the dust collector 500 according to an embodiment, the reverse-flow blocking unit 562 may be disposed counter-clockwise with respect to the communication hole 544. On the contrary, when the cyclone stream is formed clockwise, the reverse-flow blocking unit 562 may be disposed clockwise with respect to the communication hole 544.

However, the alignment of the reverse-flow blocking unit 562 is not limited thereto, and the reverse-flow blocking unit 562 may be disposed to be adjacent to the communication hole 544 regardless of a rotation direction of the cyclone stream.

Hereinafter, a cleaning apparatus according to an embodiment will be described. In this regard, description presented above will not be repeated herein.

Figure 12:
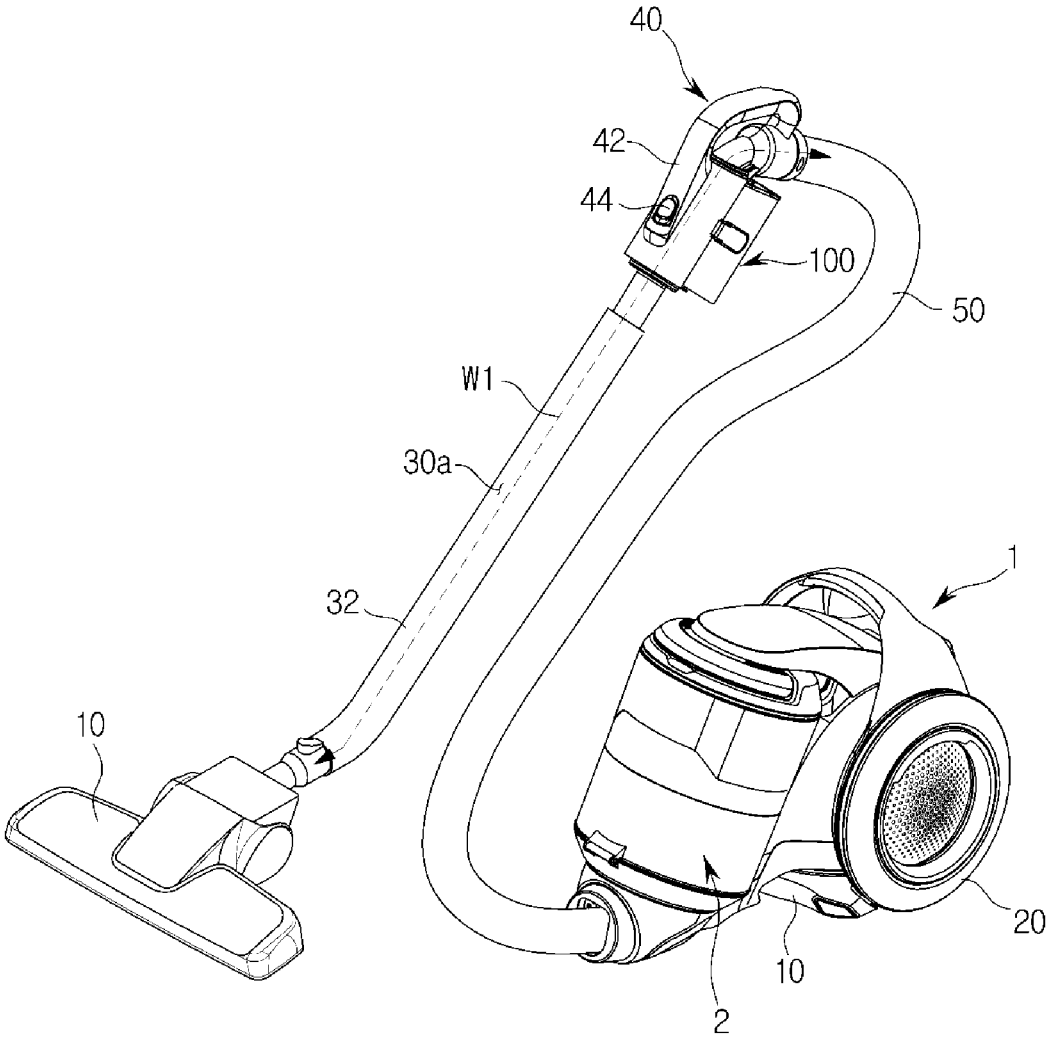
FIG. 12 is a perspective view illustrating a cleaning apparatus according to an embodiment.

FIG. 12 is a perspective view illustrating a cleaning apparatus according to an embodiment.

According to an embodiment, foreign matter is also filtered by not only the dust collector 100 but also the body dust collector 2 provided at the cleaning apparatus body 1.

The cleaning apparatus body 1 may include the body dust collector 2. As the body dust collector 2 is provided at the cleaning apparatus body 1, foreign matter is primarily filtered by the dust collector 100 and secondarily filtered by the body dust collector 2. Thus, cleaning is efficiently performed. Since the foreign matter is primarily filtered by the dust collector 100, a load of the body dust collector 2 may be relatively reduced.

Hereinafter, the cleaning apparatus body will be described.

Figure 13:
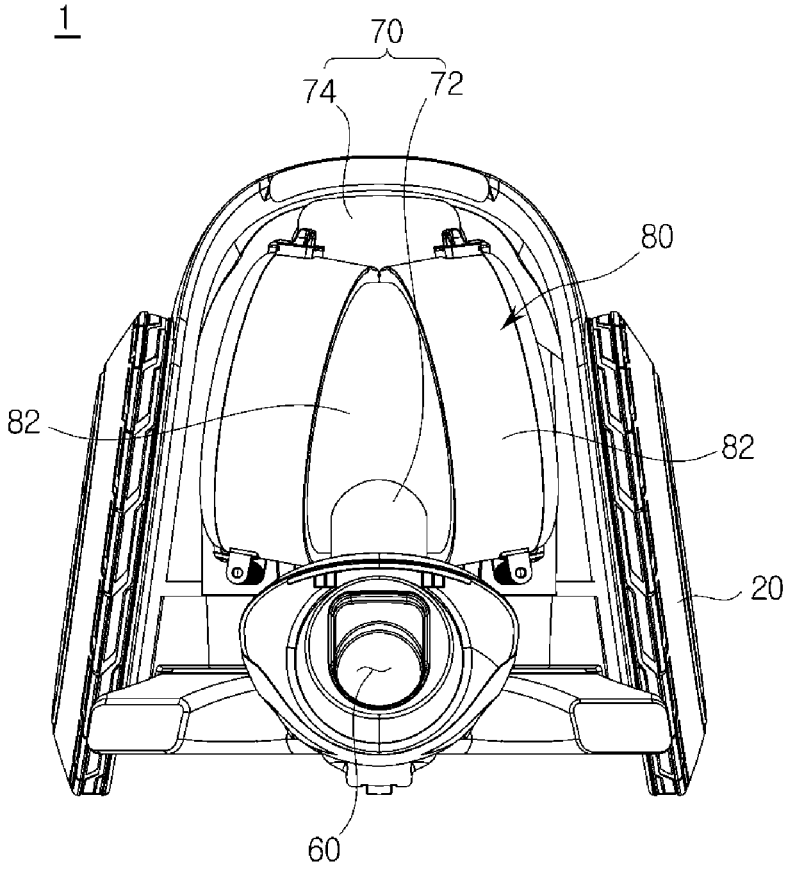
FIG. 13 is a front view illustrating a cleaning apparatus body according to an embodiment.
Figure 14:
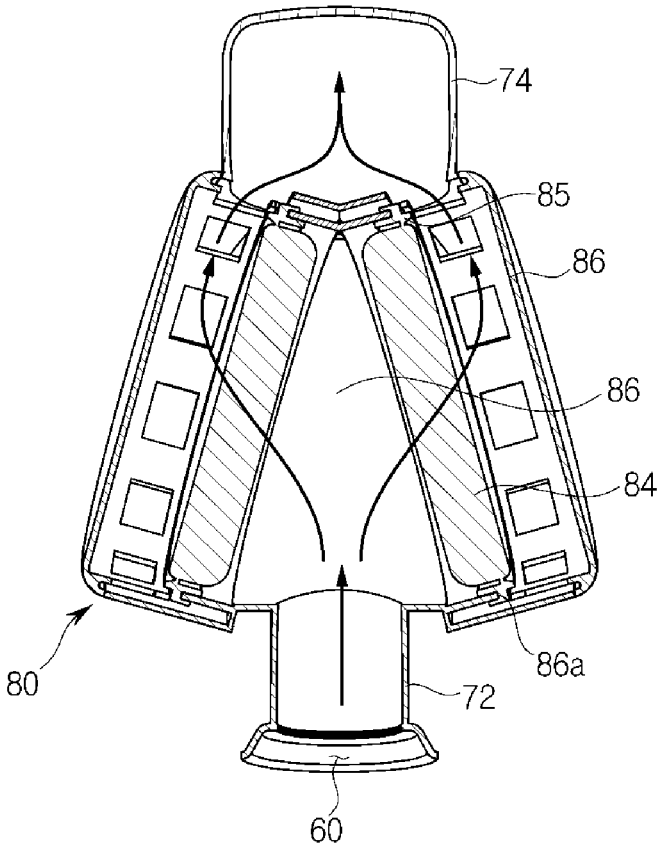
FIG. 14 is a cross-sectional view illustrating the cleaning apparatus body according to an embodiment.
Figure 15A:
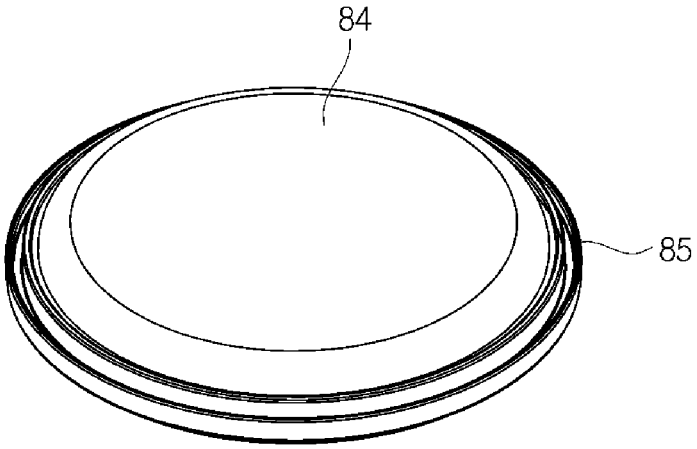
FIGS. 15A and 15B are a perspective view and a cross-sectional view illustrating a filter member according to an embodiment.
Figure 15B:
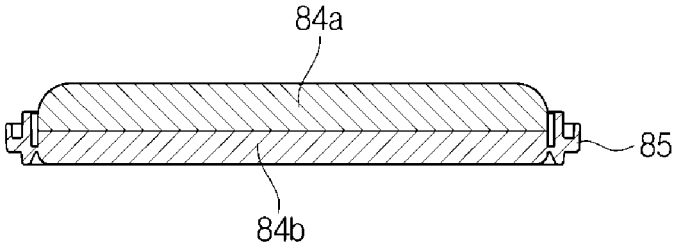

FIG. 13 is a front view illustrating a cleaning apparatus body according to an embodiment. FIG. 14 is a cross-sectional view illustrating the cleaning apparatus body according to an embodiment. FIGS. 15A and 15B are a perspective view and a cross-sectional view illustrating a filter member according to an embodiment.

The cleaning apparatus body 1 may include a suction port 60 to which one end of a hose is connected, a guide pipe 70 to guide an air flow introduced through the suction port 60 to a body dust collector (not shown), and a filter unit 80 disposed at the guide pipe 70 and filtering foreign matter contained in the air passing through the guide pipe 70.

The guide pipe 70 guides air introduced through the suction port 60. The guide pipe 70 may include an upstream guide pipe 72 disposed at an upper stream of the filter unit 80 and a downstream guide pipe 74 to guide air flowing from the filter unit 80.

The filter unit 80 may include a division chamber 82, a plurality of filter members 84, and a plurality of filter chambers 86.

The division chamber 82 forms a space where air introduced through the upstream guide pipe 72 splits off into the filter members 84. Since the division chamber 82 may include at least two filter members 84 according to an embodiment, air introduced through the upstream guide pipe 72 may split off to correspond to the number of the filter members 84. That is, a pair of filter members 84 may be used according to an embodiment, and air introduced through the upstream guide pipe 72 splits off into two branches at the division chamber 82 to pass each of the filter members 84, respectively.

The plurality of filter member 84 may be arranged in parallel such that air introduced through the upstream guide pipe 72 splits off into a plurality of branches. The air split off by the division chamber 82 passes through the plurality of filter members 84 mounted on the plurality of filter chambers 86 arranged in parallel.

The plurality of filter members 84 may be formed to surround the division chamber 82 which communicates with the upstream guide pipe 72. In other words, the plurality of filter members 84 may be formed to minimize resistance of air introduced into the division chamber 82 through the upstream guide pipe 72 and to increase a surface area in contact with air. That is, the plurality of filter member 84 may be slanted toward a proceeding direction of air.

A material used to form the filter member 84 is not limited, and any material capable of filtering foreign matter contained in air may be used. The filter member 84 may be formed of one material or a plurality of materials alternately laminated. FIG. 15B illustrates a structure in which filter members 84*a* and 84*b* formed of different materials are stacked.

According to an embodiment, the filter member 84 may have a circular shape. In this structure, flow path resistance may be minimized at the filter unit 80 disposed on the guide pipe 70.

The filter member 84 may include a filter elastic member 85 formed to surround outer edges thereof. The filter member 84 may be mounted on a filter mounting unit 86*a* disposed at the filter chamber 86. Since the filter elastic member 85 may be formed to surround the outer edges of the filter member 84, the filter member 84 may be easily separated from the filter mounting unit 86*a*.

Air that has split into a plurality of branches and passed through the plurality of filter member 84 joins together in the downstream guide pipe 74 and flows into the cleaning apparatus body 1.

Since the aforementioned embodiments are not independently implemented, one component according to an embodiment may be applied to another embodiment. For example, the dust collector as shown in FIGS. 1 to 6 may be implemented such that the cyclone unit and the dust collecting unit are separated from each other as described with respect to the dust collector shown in FIGS. 7A to 7C. Likewise, the dust collector as shown in FIGS. 1 to 6 may include a pair of cyclone generating ribs as provided in the dust collector embodiment shown in FIGS. 11A to 110.

As is apparent from the above description, the cleaning apparatus according to the disclosed embodiments may have an increased dust collecting efficiency by improving the structure of the dust collector.

In addition, the dust collecting efficiency may be increased by separating the cyclone structure and the dust collecting unit from each other in the dust collector.

In addition, foreign matter may be efficiently removed by simplifying the separation structure of the dust collector.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A cleaning apparatus, comprising:

a cleaning apparatus body comprising a drive unit configured to generate a suction force;

a head unit through which air is introduced by the suction force;

a cleaning stick configured to extend from the head unit in a lengthwise direction; and a dust collector comprising an inlet port, an outlet port spaced apart from the inlet port in the lengthwise direction, and a dust collecting flow path formed in the lengthwise direction from the inlet port to the outlet port, wherein the dust collector comprises:

a cyclone unit comprising a cyclone space including the dust collecting flow path and configured to generate a cyclone stream from the air introduced through the head unit so that foreign matter is separated from the air that flows along the dust collecting flow path;

a dust collecting unit configured to communicate with the cyclone unit and comprising a dust collecting space to collect foreign matter from the cyclone unit;

a partition rib which partially partitions the dust collecting unit from the cyclone unit in a lengthwise direction of the dust collector;

a communication gap provided between an end of the partition rib and a discharge side of the dust collector through which the foreign matter separated from the air by the cyclone unit flows from the cyclone unit into the dust collecting unit; and a prevention rib disposed in the dust collecting unit to be spaced apart from the communication gap a predetermined distance and disposed to face the communication gap to block foreign matter reversely flowing from the dust collecting unit into the cyclone unit, wherein the cyclone unit comprises:

an inlet hole formed in a side of a tube extending from the inlet port to the inside of the cyclone space and formed so that air introduced from the inlet port is radially outwardly discharged from the tube, and at least one cyclone generating rib formed spirally about the outer circumference of the tube to direct air introduced radially outward from the tube through the inlet hole to form a cyclone air stream, wherein the cyclone space of the cyclone unit and the dust collecting space of the dust collecting unit are disposed inside a dust collector body, the dust collector body comprising an opening directly communicating with the cyclone space and the dust collecting space, wherein a dust collector cover is disposed to open and close the opening of the dust collector body such that the cyclone space and the dust collecting space are accessible through the opening when the dust collector cover is open, and wherein the prevention rib protrudes inwardly from the dust collector cover.

2. The cleaning apparatus according to claim 1, wherein the dust collecting flow path constitutes at least one portion of the stick flow path.

3. The cleaning apparatus according to claim 1, wherein a cyclone stream flows in the dust collecting flow path.

4. The cleaning apparatus according to claim 1, wherein the dust collector is configured to be connectable to a dust collector mounting unit of the cleaning stick.

5. The cleaning apparatus according to claim 1, wherein the cyclone unit further comprises:

an outlet guide unit forming the outlet port and configured to guide air flowing in the cyclone unit toward the outlet port.

6. The cleaning apparatus according to claim 5, wherein the outlet guide unit is disposed at the dust collector cover.

7. The cleaning apparatus according to claim 1, wherein the inlet port and the outlet port are disposed at one side and the other side of the cyclone unit, respectively.

8. The cleaning apparatus according to claim 5, wherein centers of the inlet port, the dust collecting flow path, the outlet guide unit, and the outlet port are aligned on a same line.

9. The cleaning apparatus according to claim 1, wherein the at least one cyclone generating rib comprises a pair of cyclone generating ribs formed in a spiral shape and facing each other to split air introduced through the inlet port into two branches and form the cyclone stream.

10. The cleaning apparatus according to claim 9, wherein
the cyclone unit comprises a cyclone case forming the cyclone space in which the cyclone stream generated by the cyclone generator flows, the cyclone case having an inner diameter of approximately 80 mm or less, and
the pair of cyclone generating ribs are disposed in the cyclone case.

11. The cleaning apparatus according to claim 5, wherein
the dust collector further comprises a communication hole to allow foreign matter separated from the air that flows along the dust collecting flow path by the cyclone stream generated by the cyclone unit to move toward the dust collecting unit,
the outlet guide unit comprises a grille unit to guide air from inside of the cyclone unit toward the outlet port, and
a distance between the grille unit and the inlet port is less than a distance between the communication hole and the inlet port.

12. The cleaning apparatus according to claim 4, wherein the dust collector mounting unit comprises a catch protrusion which is coupled with a catch button of the dust collector, when the dust collector is connected to the cleaning stick.

13. The cleaning apparatus according to claim 1, wherein the dust collector is formed of a transparent material through which the inside of the dust collector is visible.

14. The cleaning apparatus according to claim 1, wherein the cleaning stick comprises:
an extension pipe connected to the head unit; and
a handle assembly having one end connected to the extension pipe and the other end connected to the cleaning apparatus body via a flexible hose, the handle assembly being configured to manipulate the extension pipe.

15. The cleaning apparatus according to claim 14, wherein the dust collector further comprises:
an inlet coupling unit extending from the inlet port and coupled to the extension pipe; and
an outlet coupling unit extending from the outlet port and coupled to the handle assembly.

16. A cleaning apparatus, comprising:
a cleaning apparatus body comprising a drive unit configured to generate a suction force;
a head unit through which air is introduced by the suction force;
a cleaning stick having one end configured to be connected to the head unit and the other end configured to be connected to the cleaning apparatus body via a flexible hose; and
a dust collector configured to be detachably installed at the cleaning stick, the dust collector comprising:
a cyclone unit configured to form a cyclone stream in a cyclone space;
a dust collecting unit configured to communicate with the cyclone unit and comprising a dust collecting space to collect foreign matter from the cyclone unit
a partition rib which partially partitions the dust collecting unit from the cyclone unit in a lengthwise direction of the dust collector;
a communication gap provided between an end of the partition rib and a discharge side of the dust collector through which the foreign matter separated from the air by the cyclone unit flows from the cyclone unit into the dust collecting unit; and
a prevention rib disposed in the dust collecting unit to be spaced apart from the communication gap a predetermined distance and disposed to face the communication gap to block foreign matter reversely flowing from the dust collecting unit into the cyclone unit,
wherein the cyclone unit comprises:
a cyclone generator configured to generate the cyclone stream in air introduced through an inlet port which communicates with the head unit; and
an outlet guide unit configured to guide air from inside of the cyclone unit toward an outlet port which communicates with the cleaning apparatus body,
wherein the cyclone generator comprises:
an inlet hole formed in a side of a tube extending from the inlet port to the inside of the cyclone space and formed so that air introduced from the inlet port is radially outwardly discharged from the tube, and
at least one cyclone generating rib formed spirally about the outer circumference of the tube to direct air introduced radially outward from the tube through the inlet hole to form a cyclone air stream,
wherein the cyclone space of the cyclone unit and the dust collecting space of the dust collecting unit are disposed inside a dust collector body, the dust collector body comprising an opening directly communicating with the cyclone space and the dust collecting space,
wherein a dust collector cover is disposed to open and close the opening of the dust collector body,
wherein the cyclone space and the dust collecting space are accessible through the opening when the dust collector cover is open, and
wherein the prevention rib protrudes inwardly from the dust collector cover.

17. The cleaning apparatus according to claim 16, wherein the dust collector is coupled to the cleaning stick to form a portion of a flow path from the head unit to the cleaning apparatus body.

18. The cleaning apparatus according to claim 16,
wherein the cyclone generator is disposed at the dust collector body, and
the outlet guide unit is disposed at the dust collector cover.

19. The cleaning apparatus according to claim 16, wherein the inlet port and the outlet port are disposed at one side and the other side of the cyclone unit, respectively.

20. The cleaning apparatus according to claim 16, wherein the inlet port and the outlet port are spaced apart from each other, and centers of the inlet port, the outlet port, the cyclone generator, and the outlet guide unit are aligned on a same line.

21. A cleaning apparatus, comprising:
a drive unit configured to generate a suction force;
a head unit through which air is introduced by the suction force;
an extension pipe configured to extend from the head unit;
a handle assembly, at which the drive unit is disposed, configured to manipulate the extension pipe; and a dust collector configured to be detachably installed at the handle assembly, the dust collector comprising:

a cyclone unit configured to form a cyclone stream in a cyclone space, and to form a portion of a flow path from the head unit to the drive unit;

a dust collecting unit configured to communicate with the cyclone unit and comprising a dust collecting space to collect foreign matter from the cyclone unit;

a partition rib which partially partitions the dust collecting unit from the cyclone unit in a lengthwise direction of the dust collector;

a communication gap provided between an end of the partition rib and a discharge side of the dust collector through which the foreign matter separated from the air by the cyclone unit flows from the cyclone unit into the dust collecting unit; and a prevention rib disposed in the dust collecting unit to be spaced apart from the communication gap a predetermined distance and disposed to face the communication gap to block foreign matter reversely flowing from the dust collecting unit into the cyclone unit, wherein the cyclone unit comprises a cyclone generator configured to generate the cyclone stream in air introduced through an inlet port which communicates with the head unit, and wherein the cyclone generator comprises:

an inlet hole formed in a side of a tube extending from the inlet port to the inside of the cyclone space and formed so that air introduced from the inlet port is radially outwardly discharged from the tube, and at least one cyclone generating rib formed spirally about the outer circumference of the tube to direct air introduced radially outward from the tube through the inlet hole to form a cyclone air stream, wherein the cyclone space of the cyclone unit and the dust collecting space of the dust collecting unit are disposed inside a dust collector body, the dust collector body comprising an opening directly communicating with the cyclone space and the dust collecting space, wherein a dust collector cover is disposed to open and close the opening of the dust collector body, wherein the cyclone space and the dust collecting space are accessible through the opening when the dust collector cover is open, and wherein the prevention rib protrudes inwardly from the dust collector cover.

22. The cleaning apparatus according to claim 21, wherein the cyclone unit comprises:

an outlet guide unit configured to guide air from the cyclone stream toward the outlet port which communicates with the drive unit.

23. The cleaning apparatus according to claim 22, wherein the drive unit comprises a driving inlet port through which air is sucked and a driving outlet port through which air is discharged, and the driving inlet port is disposed to be spaced apart from the driving outlet port at a distance of approximately 100 mm or less.

24. A cleaning apparatus, comprising:

a head unit through which air is introduced by a suction force generated by the cleaning apparatus;

a cleaning stick configured to be connected to the head unit, and configured to manipulate the head unit; and a dust collector configured to be connected to a portion of the cleaning stick, the dust collector comprising:

a cyclone unit disposed at a portion of the dust collector and comprising a cyclone generator configured to generate a cyclone stream in a cyclone space, so that foreign matter is separated from the air;

a dust collecting unit disposed at another portion of the dust collector and comprising a dust collecting space to receive the foreign matter separated from the air by the cyclone generator;

a partition rib which partially partitions the dust collecting unit from the cyclone generator in a lengthwise direction of the dust collector;

a communication gap provided between an end of the partition rib and a discharge side of the dust collector through which the foreign matter separated from the air by the cyclone generator flows from the cyclone unit into the dust collecting unit; and a prevention rib disposed in the dust collecting unit to be spaced apart from the communication gap a predetermined distance and disposed to face the communication gap to block foreign matter reversely flowing from the dust collecting unit into the cyclone unit, wherein the cyclone generator is configured to generate the cyclone stream in air introduced through an inlet port, the cyclone generator comprising:

an inlet hole formed in a side of a tube extending from the inlet port to the inside of the cyclone space and formed so that air introduced from the inlet port is radially outwardly discharged from the tube, and at least one cyclone generating rib formed spirally about the outer circumference of the tube to direct air introduced radially outward from the tube through the inlet hole to form a cyclone air stream, wherein the cyclone space of the cyclone unit and the dust collecting space of the dust collecting unit are disposed inside a dust collector body, the dust collector body comprising an opening directly communicating with the cyclone space and the dust collecting space, wherein a dust collector cover is disposed to open and close the opening of the dust collector body, and wherein the prevention rib protrudes inwardly from the dust collector cover.

25. The cleaning apparatus according to claim 24, wherein the at least one cyclone generating rib extends from the partition rib in a direction perpendicular to the lengthwise direction of the dust collector.

* * * * *